US008109627B2

(12) United States Patent
Arai

(10) Patent No.: US 8,109,627 B2
(45) Date of Patent: Feb. 7, 2012

(54) LIQUID EJECTING APPARATUS

(75) Inventor: Kenichiro Arai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 646 days.

(21) Appl. No.: 12/239,958

(22) Filed: Sep. 29, 2008

(65) Prior Publication Data

US 2009/0251521 A1 Oct. 8, 2009

(30) Foreign Application Priority Data

Sep. 28, 2007 (JP) ..... 2007-255160
Jan. 31, 2008 (JP) ..... 2008-021942
Jan. 31, 2008 (JP) ..... 2008-021943

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS 5,197,812 A 3/1993 Worley et al.
5,324,024 A 6/1994 Mori
2005/0194730 A1* 9/2005 Nishida et al. ..... 271/10.01
2008/0053793 A1* 3/2008 Yasuda et al. ..... 198/582

FOREIGN PATENT DOCUMENTS

JP 56115285 9/1981
JP 3195792 10/1991
JP 2902150 11/1992
JP 05-216365 8/1993
JP 2000-191175 7/2000
JP 2001-225987 8/2001
JP 2002-103768 4/2002
JP 2003-246524 9/2003
WO WO-97/28003 8/1997

OTHER PUBLICATIONS

International Search Report Dated Dec. 12, 2008.

* cited by examiner

*Primary Examiner* — Matthew Luu
*Assistant Examiner* — Kendrick Liu
(74) *Attorney, Agent, or Firm* — Nutter McClennen & Fish LLP; John J. Penny, Jr.; Rory P. Pheiffer

(57) ABSTRACT

A liquid ejecting apparatus is provided. A transport mechanism is that transports a sheet in a first direction. A liquid ejecting head is configured to eject liquid onto the sheet. The transport mechanism includes: a plurality of transport belts that transports the sheet and arranged in a second direction which is orthogonal to the first direction, each of the transport belts extending in the first direction and having a transport surface with which the transported sheet is brought into contact; a concave portion disposed between the transport belts adjacent to each other in the second direction; and a plurality of suction ports that sucks the sheet and disposed on both sides of the concave portion in the second direction. A distance between the liquid ejecting head and a suction surface of each of the suction ports is longer than a distance between the liquid ejecting head and the transport surface. A distance between the liquid ejecting head and a bottom of the concave portion is longer than the distance between the liquid ejecting head and the suction surface.

12 Claims, 18 Drawing Sheets

LIQUID EJECTING APPARATUS

Priority is claimed under 35 U.S.C. 119 to Japanese Patent Application No. 2007-255160 filed Sep. 28, 2007, Japanese Patent Application No. 2008-021942 filed Jan. 31, 2008, and Japanese Patent Application No. 2008-021943 filed Jan. 31, 2008, the disclosure of which, including the specifications, drawings and claims, are incorporated herein by reference in its entireties.

BACKGROUND

The present invention relates to a liquid ejecting apparatus that ejects liquid droplets such as ink from a liquid ejecting head onto a sheet.

As general liquid ejecting apparatii, ink jet printers that perform a printing process on a sheet by moving a liquid ejecting head (ink jet head) and ejecting ink droplets relative to a sheet of printing material such as a paper sheet are known.

In these ink jet printers, a phenomenon known as cock ring may occur in a print process. Specifically, cock ring occurs when a paper sheet is swollen with ripples due to ink droplets ejected onto the paper sheet. When cock ring occurs, the paper sheet may get dirty from contact with the print head or a paper jam error may occur.

Thus, a printing apparatus having a transport mechanism that sucks the paper sheet to a platen side by sucking the inside of a vacuum belt having a plurality of suction ports formed therein and transporting the paper sheet with the paper sheet adsorbed to the vacuum belt is known (for example, see Japanese Patent No. 3195792).

In addition, a printing apparatus that transports a paper sheet in a state that the paper sheet is pressed to endless belts by arranging a plurality of the endless belts having a thin and long shape and sucking air from an air suction port disposed between the endless belts is also known (for example, see Japanese Patent No. 2902150).

However, in the printing apparatus having a vacuum belt, the paper sheet may be swollen due to cock ring that occurred on the paper sheet in spots other than suction ports of the vacuum belt. In such a case, an increase of the number of the suction ports or a method of disposing the suction ports may be considered. In order to suppress the cock ring, a very strong suction force is needed. However, when the suction force is increased, a friction force between the vacuum belt and a belt receiving part increases to increase a transport load. Accordingly, it is difficult to smoothly transport the paper sheet with high precision. In addition, since a suction device that is large and expensive is needed, the costs increase. In addition, when the paper sheet is thin, ripples are generated from the increased suction force and the printing quality is deteriorated.

In the printing apparatus in which air suction ports are disposed in the platen located between the plurality of endless belts having a thin and long shape, the paper sheet on which the cock ring has occurred is adsorbed to the air suction ports to generate friction. Accordingly, it is difficult to smoothly transport the paper sheet with high precision. In such a case, it is preferable that the suction ports are disposed far from the paper sheet with respect to the upper face of the belt, in consideration of the cock ring of the paper sheet. However, in that case, it is difficult for the suction force in the air suction port to act upon the paper sheet, and the paper sheet cannot be drawn sufficiently. Accordingly, contact between the paper sheet and the print head and the paper jam error cannot be prevented sufficiently.

SUMMARY

It is therefore an object of at least one embodiment of the invention to provide a liquid ejecting apparatus capable of ejecting liquid well by smoothly transporting the sheet at high precision with contact between the sheet and the liquid ejecting head and to prevent occurrence of a paper jam error.

According to an aspect of at least one embodiment of the invention, there is provided a liquid ejecting apparatus comprising: a transport mechanism that transports a sheet in a first direction; and a liquid ejecting head that ejects liquid onto the sheet; wherein the transport mechanism includes: a plurality of transport belts that transports the sheet and arranged in a second direction which is orthogonal to the first direction, each of the transport belts extending in the first direction and having a transport surface with which the transported sheet is brought into contact; a concave portion disposed between the transport belts adjacent to each other in the second direction; and a plurality of suction ports that sucks the sheet and disposed on both sides of the concave portion in the second direction; wherein a distance between the liquid ejecting head and a suction surface of each of the suction ports is longer than a distance between the liquid ejecting head and the transport surface; and wherein a distance between the liquid ejecting head and a bottom of the concave portion is longer than the distance between the liquid ejecting head and the suction surface.

According to the above-described liquid ejecting apparatus, a sheet is sucked by the suction ports disposed on both sides of the transport belt in the width direction (the second direction). Thus, even when ripples of the cock ring are generated in the sheet due to ejection of liquid droplets, the sheet is drawn to be curved in a direction (that is, the platen side) for departing far from the liquid ejecting head by the suction ports disposed on both sides of the transport belt in the width direction. Accordingly, while the sheet is sucked to be pressed so as to face the transport belt, the sheet can be transported without being brought into contact with the liquid ejecting head.

In addition, since the suction ports are in positions located farther from the liquid ejecting head than the transport surface of the transport belt, a sheet drawn in by the suction ports is not brought into contact with the suction ports. The curvature of the sheet due to suction may be easily increased between adjacent suction ports located between the transport belts. However, since the concave portion is disposed in a position located farther from the liquid ejecting head than the suction ports, the sheet is absorbed by the concave portion. Accordingly, contact between the curved sheet and a member such as a platen that forms the transport path is prevented. Thus, a problem that the transport resistance is increased by bring the sheet drawn in by the suction ports into contact with the member forming the transport path can be eliminated. In addition, by disposing the suction port in a position close to the transport surface so as not to influence the suction operation, a sheet in which cock ring occurs can be sucked assuredly, and thus the sheet can be curved to the gap enlarging part in the direction for departing far from the liquid ejecting head.

As a result, while contact between the sheet and the liquid ejecting head and occurrence of the paper jam error are prevented, the sheet is smoothly transported with high precision, and thereby liquid can be ejected well.

The liquid ejecting apparatus may further comprise a platen facing the liquid ejecting head, wherein the platen is formed with the suction ports and the concave portion.

The bottom of the concave portion may have a flat bottom face; and a distance between the liquid ejecting head and the flat bottom face of the concave portion may be longer than the distance between the liquid ejecting head and the suction surface.

In addition, the suction ports may be disposed in both side ends of each of the transport belts in the second direction to effectively adsorb the sheet to the transport surface of the transport belt.

In addition, the transport mechanism may have a pressing roller that presses the sheet toward the concave portion and disposed in a downstream side with respect to the liquid ejecting head in the first direction.

In such a case, since the pressing roller presses the sheet between the transport belts on the downstream side in the transport direction of the sheet (the first direction), the sheet is pressed between the transport belts in a direction for departing from the liquid ejecting head. Accordingly, swell-up of the sheet can be prevented more assuredly.

In addition, the transport belts may be arranged in the second direction such that the transport belts for transporting the sheets are disposed at least in the vicinity of both side ends of respective sheets when the transport belts transport the sheets having different size in the second direction with each other. The respective transport belts for transporting the sheets may be disposed in the vicinity of the both side ends of the respective sheets are disposed in symmetrical positions with respect to the both side ends of the respective sheets.

In the above-described liquid ejecting apparatus, loads on the both side-end parts of the sheet that are located on the left side and the right side can be uniform, and accordingly, the sheet of any type can be transported in high balance.

Accordingly, the sheet of any type is smoothly transported at high precision with contact between the sheet and the liquid ejecting head and occurrence of a paper jam error prevented, and accordingly, the printing operation and the like can be performed well.

In addition, in order to easily dispose the transport belts that are disposed near the side end parts of the sheet of any type symmetrically, the respective sheets having different size with each other may be transported along a common reference position.

In addition, the concave portion may be formed with a support member that supports the transported sheet and arranged along the first direction.

In such a case, the support part is disposed between the transport belts in at least an ejection area of the liquid ejecting head. Accordingly, even when the interval of cock rings in the sheet due to adherence of liquid increases, the sheet can be support by the support part between the transport belts. Thus, the interval of the cock ring in the sheet can be decreased, and a difference of heights of ripples formed on the surface of the sheet can be decreased, and thereby an excellent print state can be acquired. In other words, the sheet is smoothly transported with high precision by suppressing the contact between the sheet and the liquid ejecting head, occurrence of a jam error, and the difference of heights of ripples caused by the cock ring, and thereby a printing operation can be performed well.

In addition, the support member may include a rib protruded toward the liquid ejecting head. The support member may include a plurality of rollers, each of which is rotatably supported by an axis which extends in the second direction.

In the above-described liquid ejecting apparatus, a sheet curved between the transport belts in the ejection area can be sufficiently supported by the support part formed of a rib or a roller. Accordingly, the difference of heights of ripples formed on the surface of the sheet can be decreased, and thereby an excellent print state can be acquired.

In addition, a distance between one of the transport belts and one of the suction ports may be shorter than a distance between the support member and the one of the suction ports.

Accordingly, generation of ripples on the sheet can be suppressed by the support part while suction of the sheet in the suction port is sufficiently performed.

In addition, a distance between the liquid ejecting head and the support member may be longer than the distance between the liquid ejecting head and the transport surface.

In the above-described liquid ejecting apparatus, the support part is disposed farther from the liquid ejecting head than the transport surface of the transport belt for the sheet. Accordingly, unnecessary contact between the support part and a sheet in which cock ring scarcely occurs before adherence of liquid or the like can be suppressed, and thereby the sheet can be transported well.

According to another aspect of at least one embodiment of the invention, there is provided a liquid ejecting apparatus comprising: a transport mechanism that transports a sheet in a first direction; and a liquid ejecting head that ejects liquid onto the sheet; wherein the transport mechanism includes: a plurality of transport belts that transports the sheet and arranged in a second direction which is orthogonal to the first direction, each of the transport belts extending in the first direction and having a transport surface with which the transported sheet is brought into contact; an opening disposed between the transport belts adjacent to each other in the second direction; and a plurality of suction ports that sucks the sheet and disposed on both sides of the opening in the second direction; and wherein a distance between the liquid ejecting head and a suction surface of each of the suction ports is longer than a distance between the liquid ejecting head and the transport surface.

According to still another aspect of at least one embodiment of the invention, there is provided a liquid ejecting apparatus comprising: a transport mechanism that transports a sheet in a first direction; and a liquid ejecting head that ejects liquid onto the sheet; wherein the transport mechanism includes: a plurality of transport belts that transports the sheet and arranged in a second direction which is orthogonal to the first direction, each of the transport belts extending in the first direction and having a transport surface with which the transported sheet is brought into contact; a concave portion disposed between the transport belts adjacent to each other in the second direction; and a suction region that sucks the sheet toward the concave portion and disposed between the transport belts adjacent to each other in the second direction; wherein a distance between the liquid ejecting head and a suction surface of the suction region is longer than a distance between the liquid ejecting head and the transport surface; and wherein a distance between the liquid ejecting head and a bottom of the concave portion is longer than the distance between the liquid ejecting head and the suction surface.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, an example of a liquid ejecting apparatus according to an embodiment of the present invention will be described with reference to the accompanying drawings. In this embodiment, an ink jet printer as the liquid ejecting apparatus will be described as an example.

Figure 1:
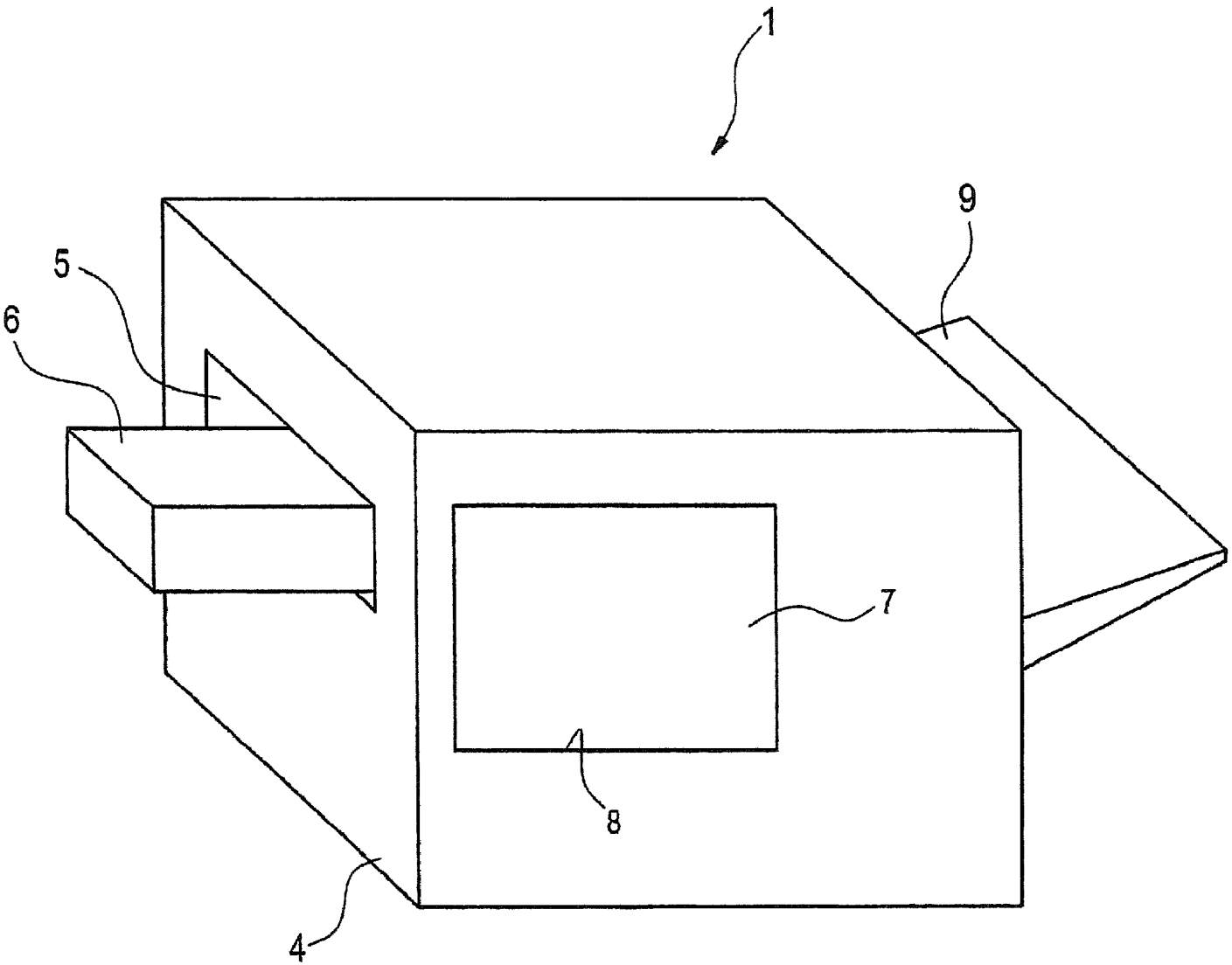
FIG. 1 is an external perspective view of a printer as an example of a printing apparatus according to an embodiment of the present invention.
Figure 2:
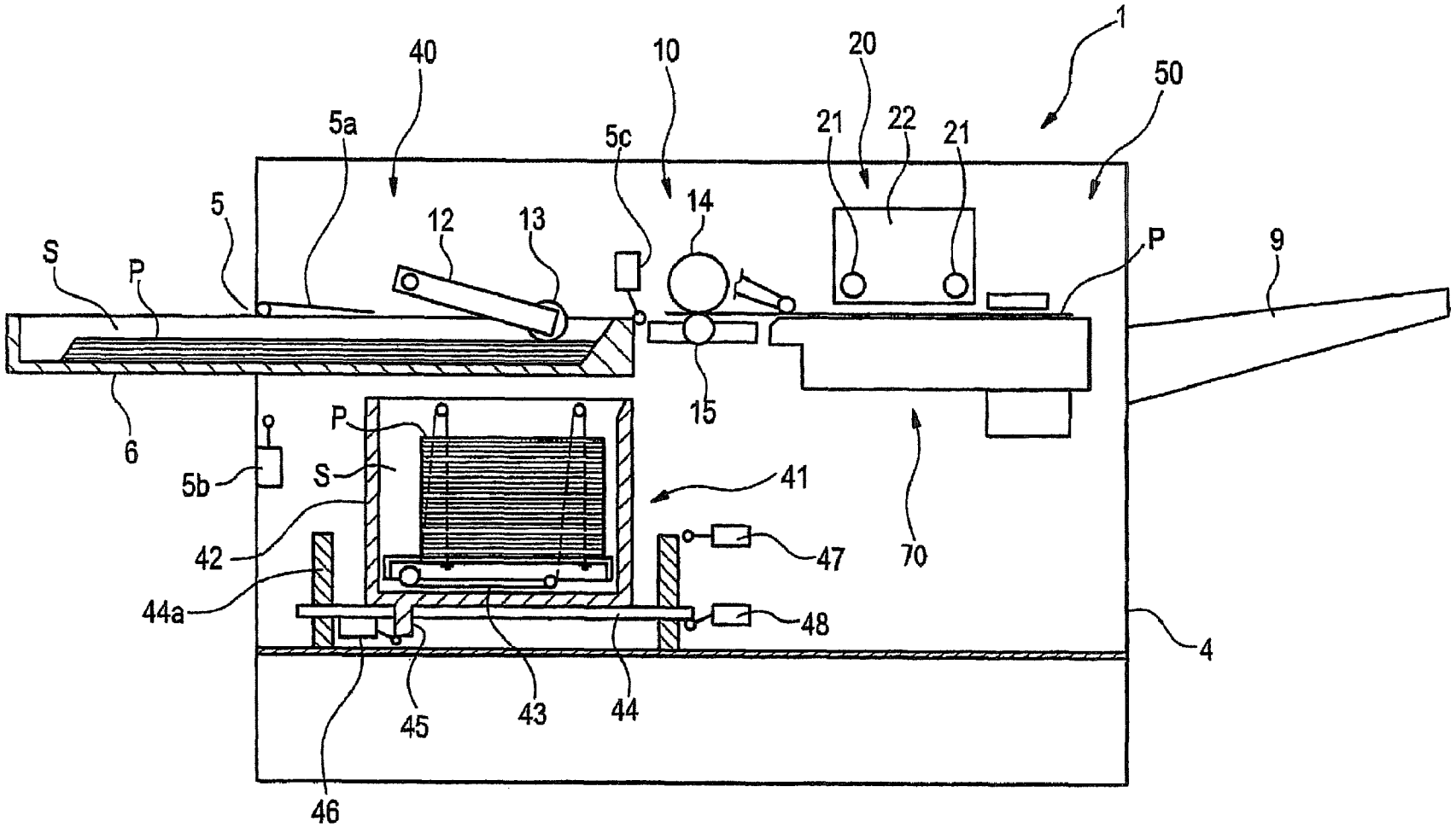
FIG. 2 is a schematic side cross-section view showing the internal configuration of the printer shown in FIG. 1.

The printer 1 according to this embodiment is a front-feed/rear-discharge type ink jet printer as an example. As shown in FIG. 1, in the center of a front face (a left-side end face in FIG. 1) of a device case 4, a sub cassette loading gate 5 is formed. As shown in FIG. 2, in the sub cassette loading gate 5, a sub cassette 6 that houses a paper sheet (sheet) P, which is a large printing material in the shape of a sheet, in a housing space S is loaded in a detachably attachable manner. A rear half portion of the sub cassette 6 is loaded into the inside of the device case 4, and a front half portion thereof protrudes from the device case 4.

As shown in FIG. 1, on a side face (a front-side face in FIG. 1) of the device case 4, a window part 8 having a gate 7 that can be opened or closed toward the outer side is disposed. In a state that the gate 7 is open, a main cassette 42 can be loaded or unloaded. As shown in FIG. 2, in the main cassette 42, paper sheets P that are small printing sheets are housed in a housing space S in a stacked state. In addition, on a rear face of the device case 4 (a right-end face in FIG. 1), a paper discharging tray 9 that receives a paper sheet P for which a printing process has been completed is disposed.

Figure 3:
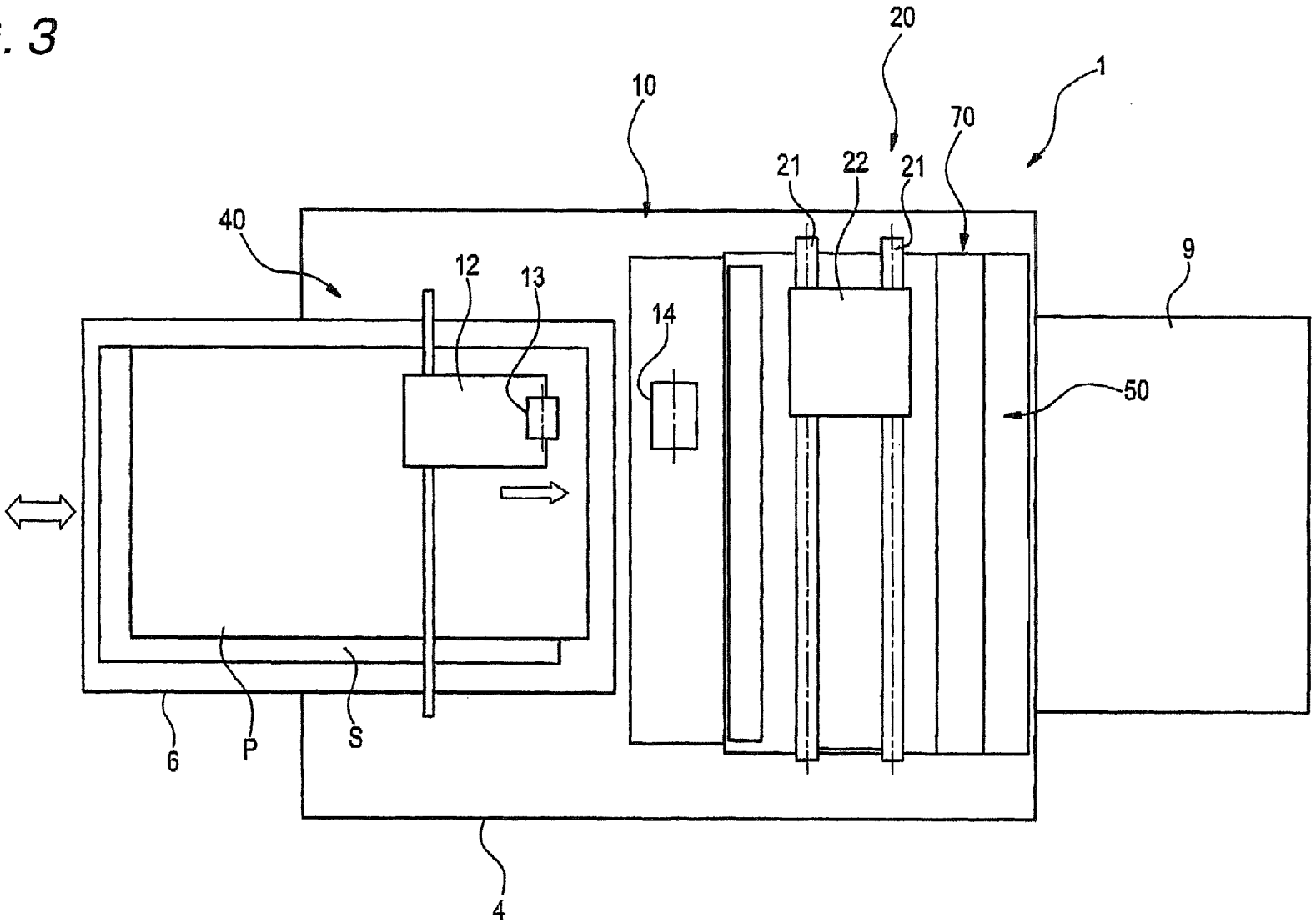
FIG. 3 is a schematic plane cross-section view showing the internal configuration of the printer shown in FIG. 1.

As shown in FIGS. 2 and 3, a cassette installation unit 40 is disposed inside the device case 4 on the front part, and a paper feeding unit 10 is disposed on the downstream side (that is, the rear side) of the cassette installation unit 40. In addition, a print processing unit 20 and a paper discharging unit 50 are disposed on the downstream side of the paper feeding unit 10.

An opening/closing cover 5*a* that can be turned inside the sub cassette loading gate 5 is disposed in the cassette installation unit 40. The opening/closing cover 5*a* is turned towards the interior of the device case 4 and brought into contact with the sub cassette 6 by loading the sub cassette 6 into the sub cassette loading gate 5, and thereby opening the sub cassette loading gate 5. On the other hand, the opening/closing cover 5*a* is turned towards the loading gate 5 by unloading the sub cassette 6 from the sub cassette loading gate 5, and thereby closing the sub cassette loading gate 5.

In addition, an opening/closing cover detecting sensor 5*b* that is turned on or off by opening or closing the opening/closing cover 5*a* is disposed in the sub cassette loading gate 5.

In a position on the front side and inside printer 1, a sub cassette detecting sensor 5*c* that is turned on or off by attaching or detaching the sub cassette 6 to/from the printer 1 is disposed in the loading direction of the sub cassette 6.

In addition, a main cassette installation unit 41 is disposed inside the device case 4. In the main cassette installation unit 41, the main cassette 42 is housed in a detachably attachable manner.

The main cassette 42 has a housing space S in which small paper sheets P are stacked and housed therein. A paper elevating mechanism 43 is disposed inside the housing space S. The position of the uppermost part of the small paper sheets P that are housed inside the housing space S in a stacked state by the paper elevating mechanism 43 becomes a predetermined height position.

The main cassette installation unit 41 has an elevation plate 44 on which the main cassette 42 is placed. The elevation plate 44 is configured to be raised or lowered by the elevation mechanism 44*a*.

In addition, a main cassette detecting sensor 46 that is turned on or off by a pin 45 that appears or disappears as the main cassette 42 is attached to or detached from the main cassette installation unit 41 is disposed on the elevation plate 44.

Figure 4:
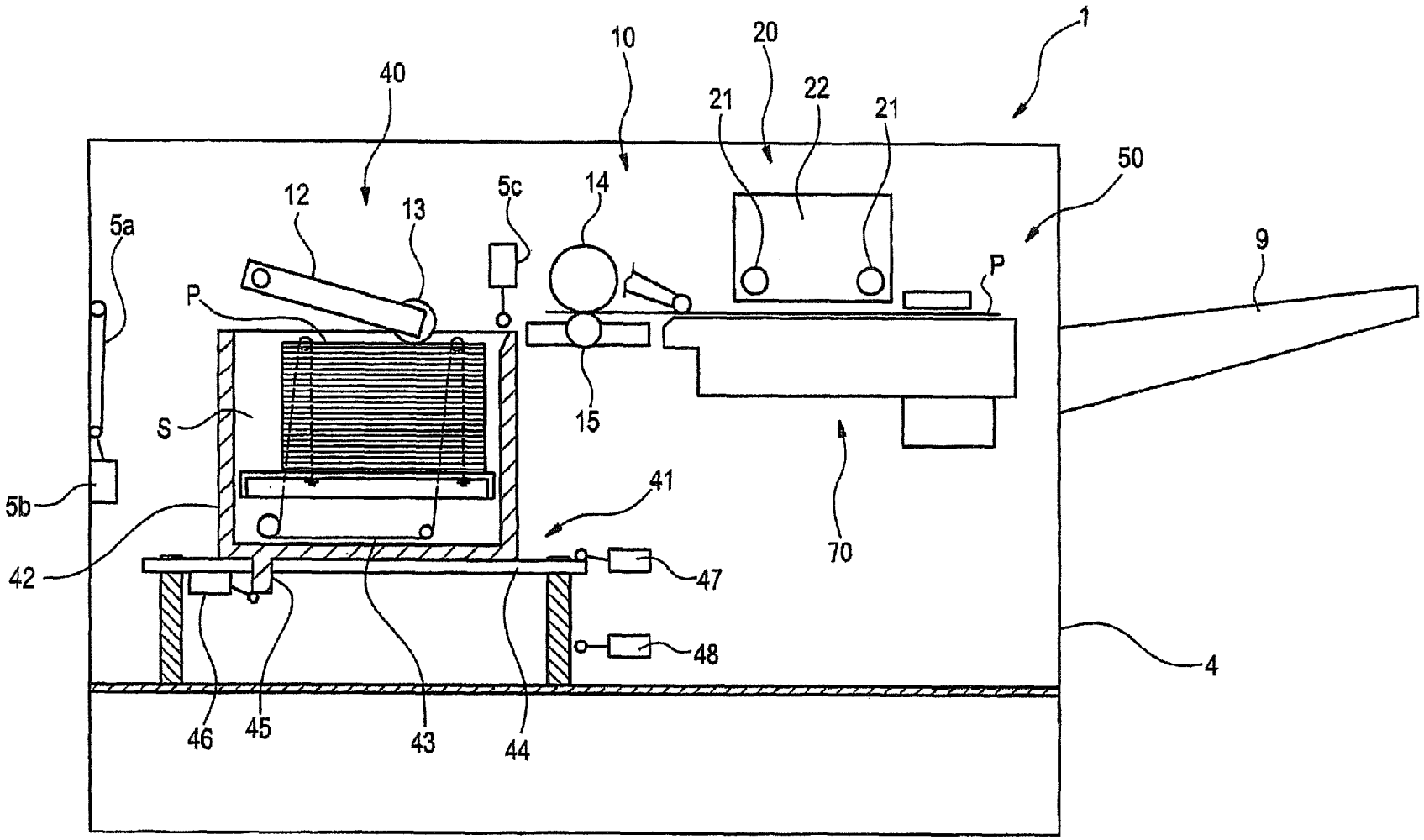
FIG. 4 is a schematic side cross-section view of a printer showing a state in which a paper sheet can be fed from a main cassette.
Figure 5:
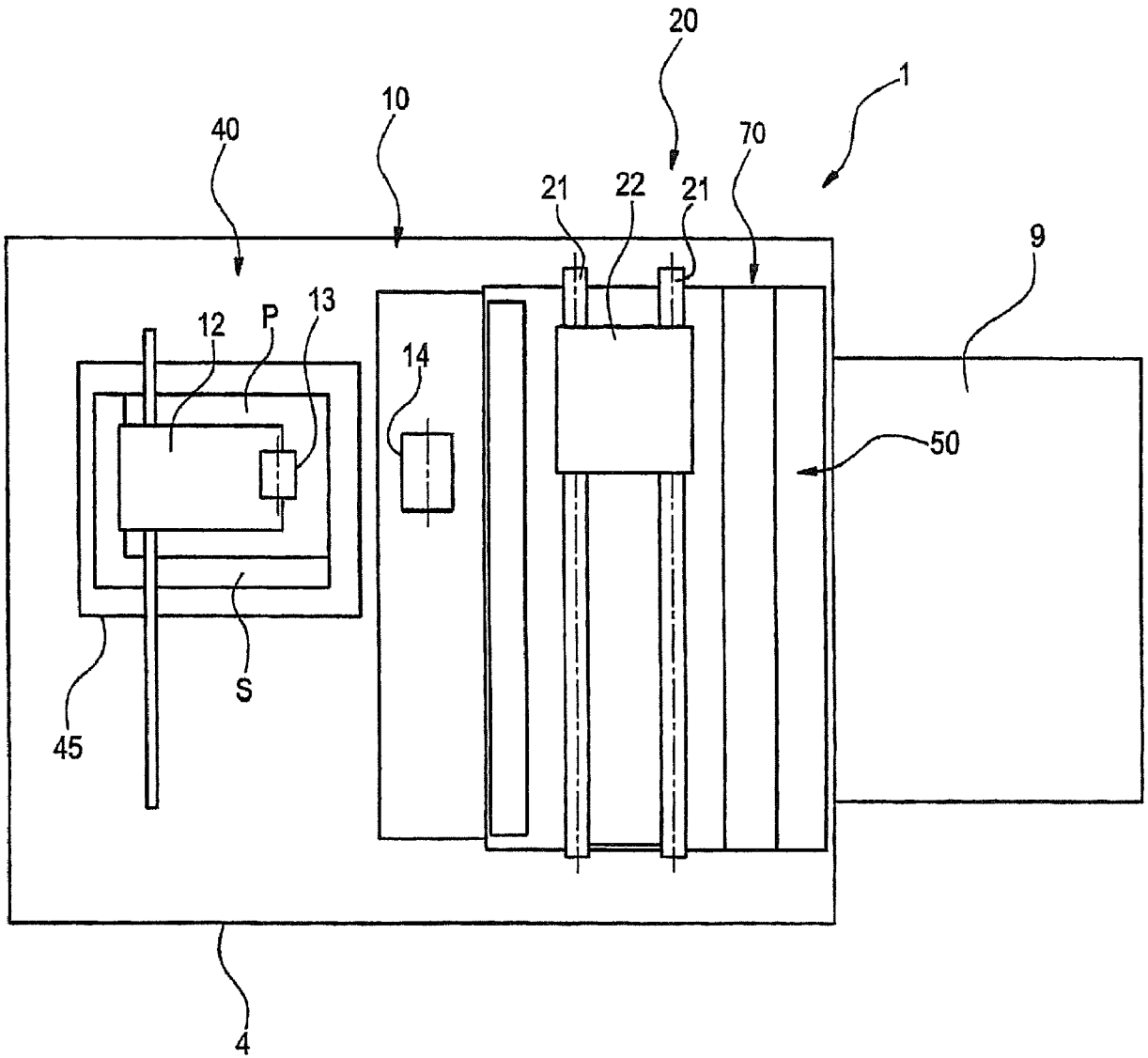
FIG. 5 is a schematic plane section view showing a state in which a paper sheet can be fed from the main cassette.

As shown in FIGS. 4 and 5, the main cassette installation unit 41, by elevating the sub cassette 6 in a detached state using the elevation mechanism 44*a*, the main cassette 42 on the elevation plate 44 is disposed in a paper feeding position. In this state, a pickup roller 13 can feed a paper sheet P.

On the contrary, when the elevation plate 44 is lowered by the elevation mechanism 44*a*, the main cassette 42 is disposed in a standby position that is deviated from the paper feeding position. In this state, the main cassette 42 can be acquired through the window part 8 of the device case 4. In addition, the sub cassette 6 can be loaded through the sub cassette loading gate 5 in a state that the main cassette 42 is disposed in the standby position.

In addition, a feed position detecting sensor 47 that detects disposition of the main cassette 42 in the paper feeding position and a standby position detecting sensor 48 that detects disposition of the main cassette 42 in the standby position are disposed in the main cassette installation unit 41.

In the paper feeding unit 10, a pickup roller 13 is disposed to be supported by a front end of a frame 12 that is supported to be able to pivot inside the device case 4. By bring the pickup roller 13 into contact with a paper sheet P that is disposed downward, the uppermost sheet of the paper sheets P are continuously sent out to the rear side (the right side in FIGS. 2 and 3) one after another and are sent to the print processing unit 20 on the rear side.

In the print processing unit 20, an ink jet head (print head) 22, which prints a desired image by ejecting liquid droplets (ink droplets) of ink and moves relatively with respect to a supplied paper sheet P in the width direction of the paper sheet P, is disposed to be movable along guide shafts 21 and 21 that are disposed to be orthogonal to the paper feed direction.

Figure 6:
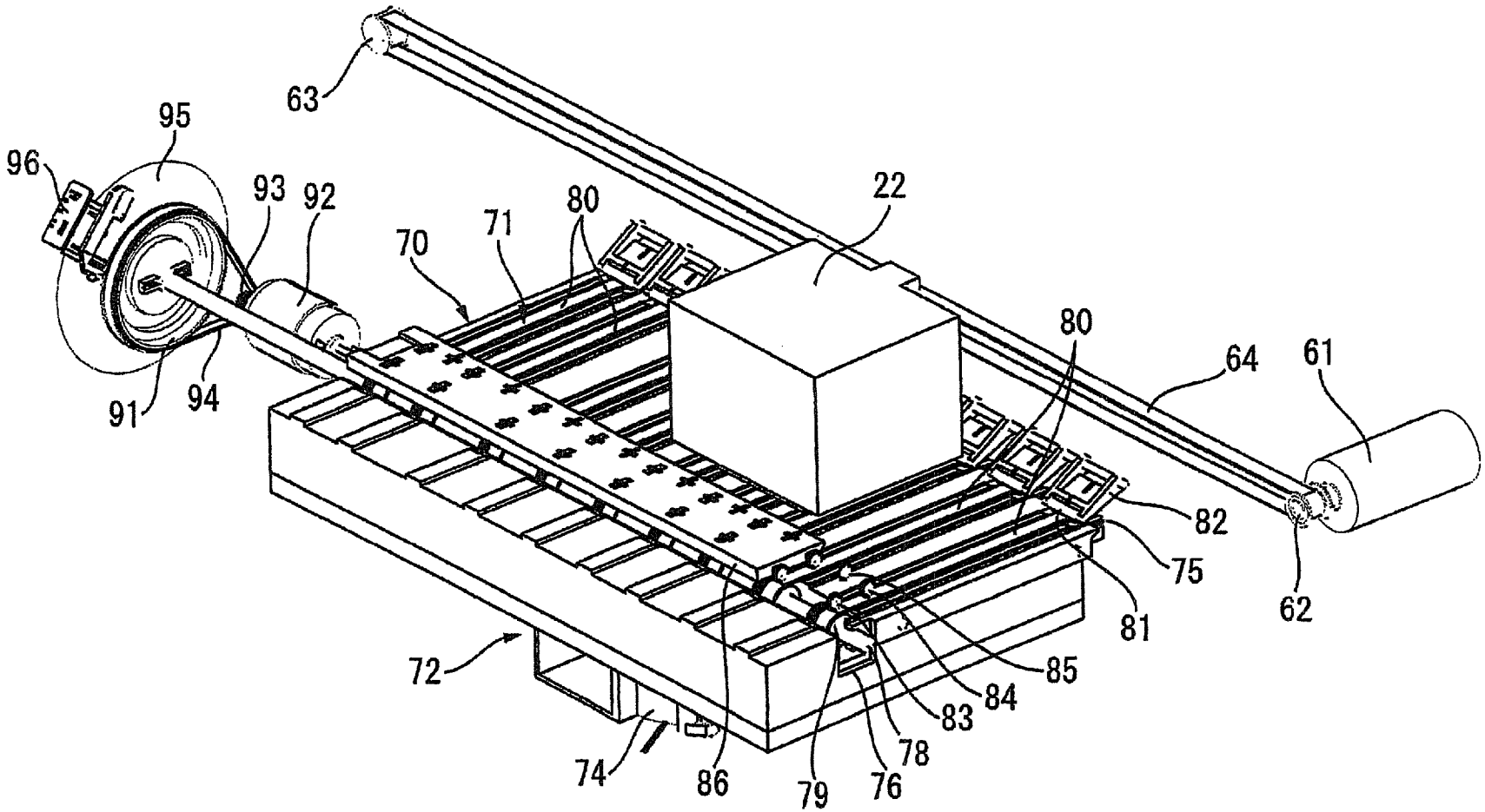
FIG. 6 is a perspective view of a print processing unit.

As shown in FIG. 6, the ink jet head 22 is fixedly attached to a part of a driving belt 64 wound over a driving pulley 62 and a driven pulley 63 that are rotated by a driving motor 61. The ink jet head 22 is moved along the guide shafts 21 and 21 as the driving pulley 62 is rotated by the driving motor 61 and as the driving belt 64 travels. The ink jet head 22 according to this embodiment includes an area, in which an ink nozzle is formed, that has a length of 2 inches in the transport direction of the paper sheet and is relatively large as an ink jet head of an ink jet printer.

In addition, a transport mechanism 70 is disposed below the ink jet head 22 to transport a paper sheet P as a printing material and to support the paper sheet from below.

As shown in FIGS. 6 to 10, the transport mechanism 70 has an upper face as a reference face that is a platen 71 for printing and includes a suction block 72 that faces the ink jet head 22. The suction block 72 is in the shape of a box in which a space part S1 is formed and includes a suction blower 74 that sucks air located inside the space part S1 in the lower part thereof.

On the upstream side of the suction block 72 constituting the transport mechanism 70, a plurality of tension pulleys 75 and guide pulleys 73 (see FIG. 11) are supported with an interval interposed therebetween. In addition, near the downstream side of the suction block 72, a groove part 76 that opens toward the upper side is formed in the width direction of the suction block 72 (see FIGS. 8 and 9). A rotation shaft 78 is disposed on the groove part 76. On the rotation shaft 78, a same number of driving pulleys 79 as that of the tension pulleys 75 are disposed in positions facing the tension pulleys 75. A transport belt 80 is wound over the driving pulley 79, the tension pulley 75, and the guide pulley 73, and the transport belts 80 are arranged in the width direction of the suction block 72 with an interval interposed therebetween. While the driving pulley 79 and the guide pulley 73 have teeth on their outer peripheries, the tension pulley 75 does not have any tooth.

Here, the printer 1 performs a printing process for a plurality of types of paper sheets P having different widths. Accordingly, the plurality of the transport belts 80 that are disposed along the width direction with an interval interposed therebetween are disposed in correspondence with the different widths of various paper sheets P.

Hereinafter, disposition of the transport belts 80 will be described.

Figure 10:
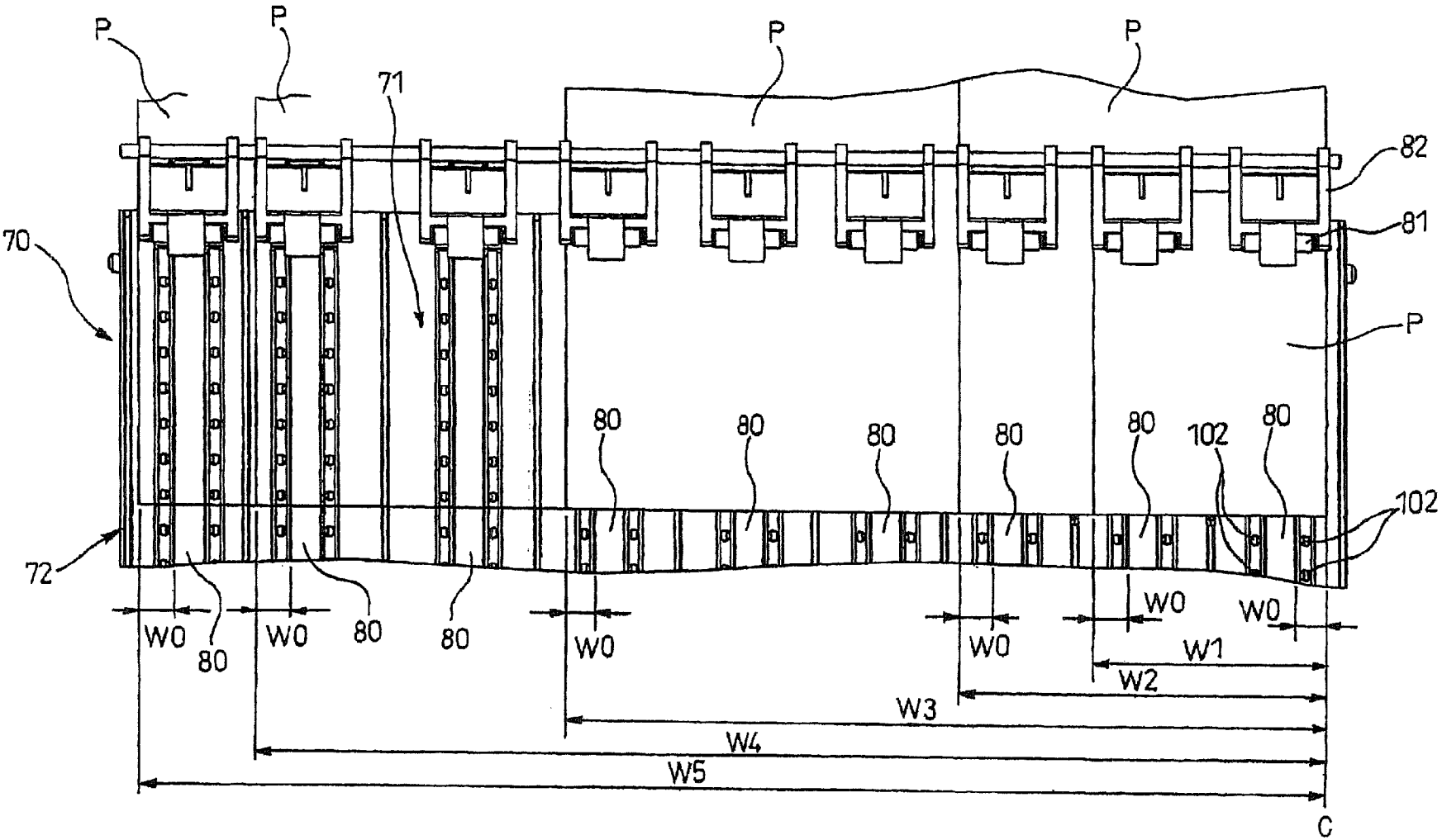
FIG. 10 is a plan view of a transport mechanism.

As shown in FIG. 10, a reference C for position adjustment is set on one side (the right side in FIG. 10) of the platen 71 that is a reference face for printing for the upper face of the suction block 72 of the transport mechanism 70. In the transport mechanism 70, a paper sheet P having any width is transported with its one side aligned to and along the reference C for position adjustment A paper sheet P used for printing may be a paper sheet that is a specific standard size such as a business card size having a width of W1, a post card size having a width of W2, an A4 size having a width of W3, an A3 size having a width of W4, or an A3-wide size having a width of W5.

In the transport mechanism 70, the transport belts 80 are disposed in a position near both side-end parts of any of the above-described paper sheets P.

The transport belts 80 disposed near both ends of a paper sheet P of any type are symmetrically disposed along the width direction of the paper sheet P. The distance W0 from each of the both end parts of the paper sheet P of any type to a transport belt 80 located nearby is about 10 mm. In addition, suction ports 102 to be described later are disposed below edges of the paper sheets P protruding toward the side from the transport belts 80 near the both end parts.

Figure 11:
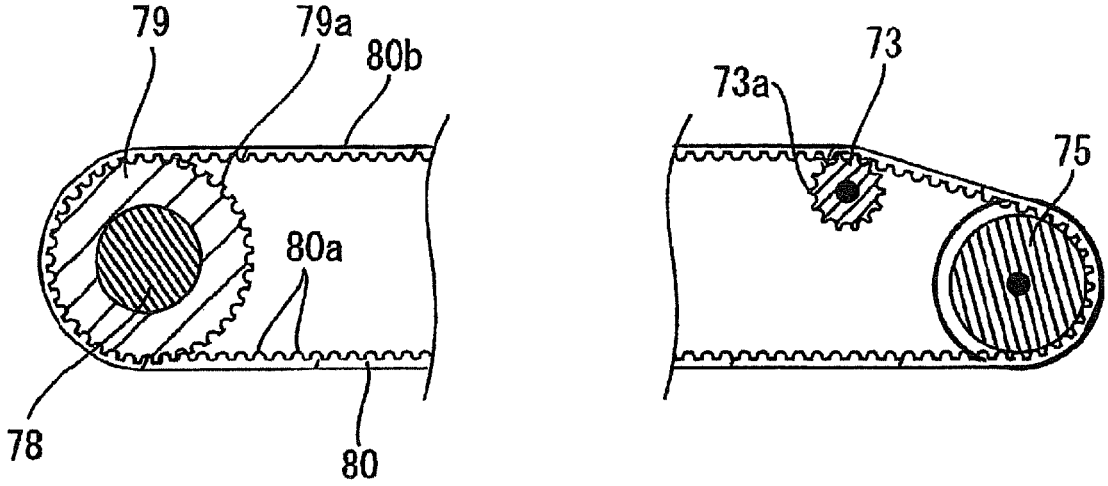
FIG. 11 is an enlarged side view of the transport belt part.

As shown in FIG. 11, the transport belt 80 is a timing belt that has a plurality of teeth 80*a* on its inner periphery side. The teeth 80*a* of the transport belt 80 are engaged with teeth 73*a* and 79*a* of the guide pulley 73 and the driving pulley 79. In addition, the tension pulley 75 is elastically biased in a direction (the right side in FIGS. 8, 9 and 11) for departing from the driving pulley 79 to apply a predetermined tension to the transport belt 80.

A pressing roller 81 that faces the guide pulley 73 is disposed on a part of the transport belt 80 located on the upstream side. The pressing roller 81 is rotably supported by a frame 82 and is biased to the guide pulley 73 side.

Figure 9:
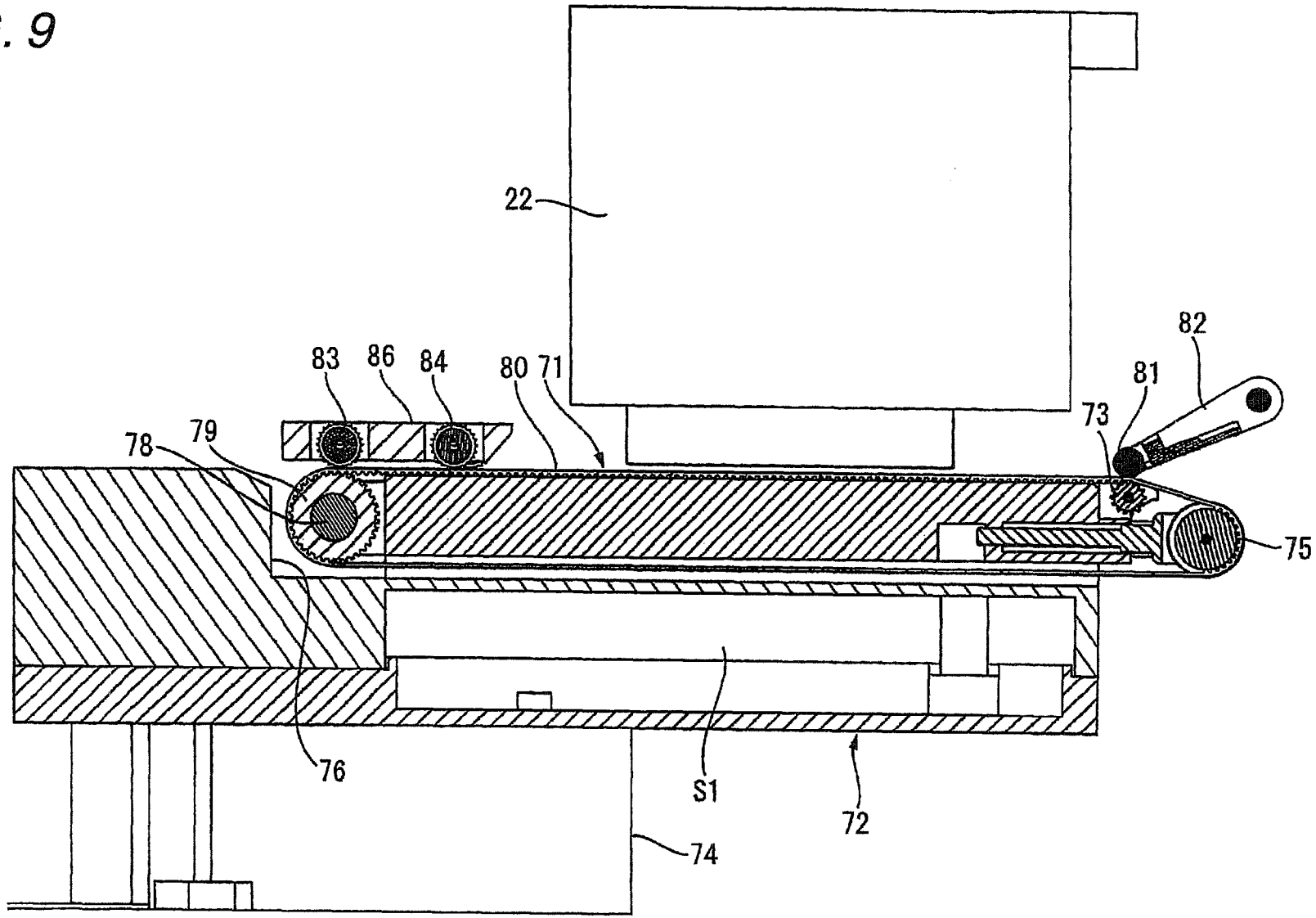
FIG. 9 is a cross-section view of a transport belt part of the print processing unit in the transport direction of a paper sheet.

In addition, a plurality of pairs of transport rollers 83 and 84 that are disposed in positions for facing the transport belt 80 with spaced apart therebetween along the transport belt 80 and a pressing roller 85 disposed between the transport belts 80 are disposed on a downstream part of the transport belt 80 (see FIG. 9). The transport rollers 83 and 84 and the pressing roller 85 are rotably supported by a bracket 86. The transport roller 83 is disposed directly above the driving pulley 79 and a paper sheet P is pinched between the transport roller 83 and the driving pulley 79 through the transport belt 80. The transport roller 84 is disposed on the upstream side of the transport roller 83. The transport roller 84 prevents swell of a paper sheet P on the transport belt 80 before the paper sheet reaches the transport roller 83. The pressing roller 85 prevents swell of the paper sheet P between the transport belts 80 on the upstream side of the driving pulley 79.

A transmission pulley 91 is disposed on one end part of the rotation shaft 78. A transmission belt 94 is suspended over the transmission pulley 91 and a rotation pulley 93 of the transport motor 92. In addition, , an encode plate 95 having a circular disk shape together with the transmission pulley 91 is disposed on the rotation shaft 78. By detecting a plurality of slits (not shown in the figure) formed near the outer periphery of the encode plate 95 along the main direction by using a detector 96, the rotation position of the rotation shaft 78 can be detected.

Figure 7:
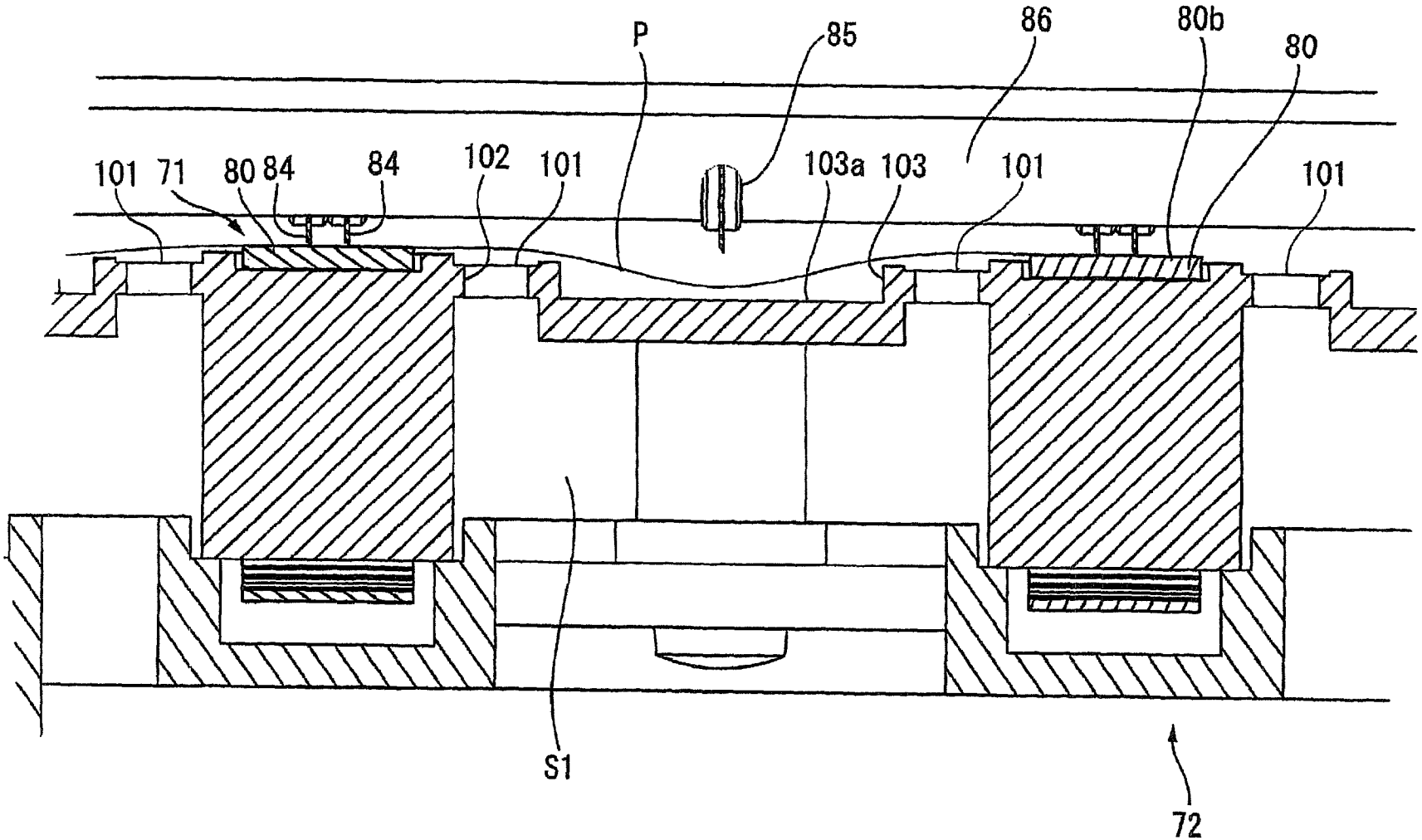
FIG. 7 is a cross-section view of the print processing unit in the width direction.
Figure 8:
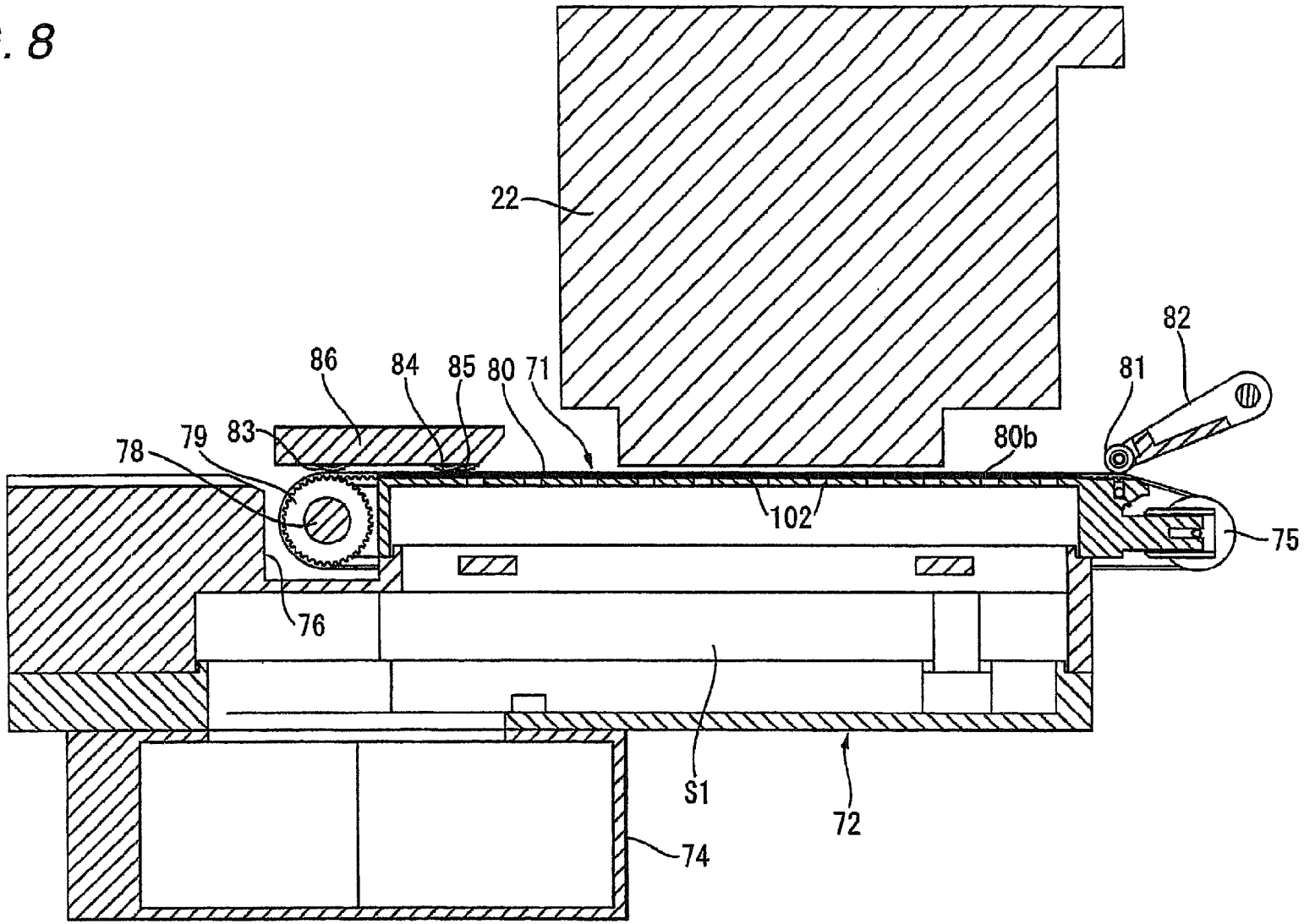
FIG. 8 is a cross-section view of a suction port part of the print processing unit in the transport direction of a paper sheet.

As shown in FIG. 7, on the upper face of the suction block 72, on both sides of each transport belt 80 along the width direction, a suction face 101 that is located farther from the ink jet head 22 than a transport surface 80*b* in a (height) direction orthogonal to the width direction and the transport direction to be slightly lowered from the transport surface 80*b* of the paper sheet P which is in a position having a same height as that of the upper face of the transport belt 80 is formed along the transport belt 80. In the suction face 101, a plurality of suction ports 102 that are communicated with the space part S1 is formed along the transport direction. In addition, between suction ports 102 adjacent to each other in the width direction of the transport belt 80, a concave part 103 that is a gap enlarging part is formed. A bottom face 103*a* of the concave part 103 is disposed in a low position that is located farther from the ink jet head 22 than the suction face 101. As shown in FIG. 7, the concave part 103 is disposed between the transport belts which are adjacent to each other in the width direction of the transport belt 80 (in a direction orthogonal to the transport direction), and the suction ports 102 are disposed in both sides of the concave part 103. In other words, the suction port 102 is disposed between the transport belts 80 which are adjacent to each other. However, in order to suck the sheet P toward the concave part 103, the suction port 102 may be disposed in one side of the concave part 103 in the direction orthogonal to the transport direction. In addition, a suction region in which the suction port 102 is formed may be disposed in both sides of the concave part 103 in the transport direction. The suction region may be disposed in one side of the concave part 103.

In this embodiment, as described above, the ink jet head 22 is relatively large, and thus, a gap (that is, a distance from the guide pulley 73 to the driving pulley 79) for pinching the paper sheet P on the upstream side of the ink jet head 22 and the downstream side is relatively long. Accordingly, the paper sheet P can be easily swelled when the paper sheet P is not sucked downward.

In the transport mechanism 70, when the transport motor 92 is driven, the turning force of the rotation pulley 93 is transferred to the transmission pulley 91 through the transmission belt 94, and rotates the rotation shaft 78. Accordingly, the plurality of the transport belts 80 that are wound over the driving pulley 79, the tension pulley 75, and the guide pulley 73 travels.

Then, the paper sheet P that is transported between the transport belt 80 and the pressing roller 81 is pinched by the transport belt 80 and the pressing roller 81 to be sent to the rear side. Furthermore, the paper sheet P is transported downstream side by the transport belt 80 while a printing process is performed by the ink jet head 22.

At that moment, cock ring in which the paper sheet P is swollen by ink droplets ejected from the ink jet head 22 may occur and causes ripples in paper sheet P. In the transport mechanism 70 according to this embodiment, when air inside the space part S1 is sucked in by the suction blower 74, the paper sheet P is sucked downward by the suction ports 102 that are disposed on both sides of the transport belt 80 in the width direction. Accordingly, even when the cock ring causes ripples in the paper sheet P, the paper sheet P is drawn downward on both sides of the transport belt 80 along the width direction to be curved. As a result, the swell of the paper sheet between the transport belts 80 is suppressed while the paper sheet P is transported in accordance with travel of the transport belt 80 with the paper sheet pressed to face the transport belt 80 from both sides of the transport belt 80 in the width direction. Accordingly, a problem that the paper sheet is brought into contact with the ink jet head 22 or the like is prevented.

In addition, since the suction face 101 is disposed in a position slightly lower than the transport surface 80*b*, a relatively short distance between the paper sheet P and the suction port 102 is configured and contact between the suction face 101 and the paper sheet P prevented. Accordingly, it is possible to effectively apply a suction force to the paper sheet P without markedly increasing the suction force of the suction blower 74. Since the paper sheet P is inclined to be curved toward the suction ports 102 near both side ends of the transport belt 80, from the both side ends as reference points, the paper sheet P may be easily curved in the shape of a valley in a center portion between the transport belts 80 along the width direction. However, since the bottom face 103*a* of the concave part 103, which is disposed in the center of the transport belts 80, is disposed in a position one step lower than that of the suction face 101, the contact between the paper sheet P and the bottom face 103*a* is reliably prevented. Thus, a problem that the paper sheet P drawn downward is brought into contact with the suction port 102 and the bottom face 103*a* of the concave part 103 to increase the transport resistance does not occur.

Here, according to the printer 1 of this embodiment, the transport belts 80 of the transport mechanism 70 are symmetrically disposed in positions near both ends of the paper sheets P having different widths W1 to W5. Accordingly, an edge that is an end of the paper sheet P is not loaded directly on the transport belt 80 and the edge of the paper sheet P is not disposed far from the transport belt 80. In addition, the paper sheets P having the different widths W1 to W5 are smoothly transported in balance, and accordingly, the probability for a paper jam error caused by an unbalanced transport is reduced.

Thereafter, the paper sheet P is discharged to the paper discharging tray 9 while being pinched by the transport belt 80 and the transport rollers 83 and 84.

At this moment, the paper sheet P is pressed downward between the transport belts 80 by the pressing roller 85 that is disposed in the center of the transport belts 80. Accordingly, the paper sheet P in which the cock ring occurs is curved downward between the transport belts 80 more reliably.

As described above, according to the printer 1 of this embodiment, since the paper sheet P is sucked by the suction port 102 that is disposed in a position slightly lower than the transport surface 80*b* disposed on both sides of the transport belt 80 in the width direction, the paper sheet P can be effectively sucked down with a relatively weak suction force. Accordingly, although the ink jet head 22 is large, the swell of the paper sheet P over the entire transport area due to the transport belt 80 can be prevented, and contact between the paper sheet P and the ink jet head 22 can be prevented. Thus, occurrence of a jam error can be prevented. In addition, since the bottom face 103*a* of the concave part 103 located between the transport belts 80 is in a position lower than the suction port 102, the paper sheet P curvature due to suction is not brought into contact with the platen side. Accordingly, the paper sheet P can be transported with high precision without increasing the transport resistance. As a result, a printing operation with high precision can be performed.

In addition, in the transport mechanism 70, the pressing roller 85 presses the paper sheet P in a position facing the concave part 103, on the upstream side of a position in which the paper sheet P is pinched on the downstream side in the transport direction, and accordingly, the swell of the paper sheet P between the transport belts 80 can be more reliably prevented.

In addition, by using a timing belt as the transport belt 80, a transport operation can be controlled with high precision regardless of a thickness of the transport belt 80. In addition, the precision of transport of the paper sheet P is increased without idle rotation the transport belt 80, and accordingly, a printing operation with high precision can be performed.

In addition, according to the printer 1 of this embodiment, transport belts 80 are disposed at least near both side-end parts of various types of paper sheets P having different widths, and the paper sheet P is transported by the plurality of transport belts 80 including the transport belts disposed near the both ends of the paper sheet P. Accordingly, various types of paper sheets P having different widths can be transported with high degree of balance.

Furthermore, since the transport belts 80 disposed in positions near both ends of the paper sheet P to be transported are disposed in positions symmetrical with respect to the paper sheet P in the width direction, various types of paper sheets P having different widths can be transported with higher degree of balance.

As a result, various types of paper sheets P can be smoothly transported at high precision with contact between the paper sheet P and the ink jet head 22 and occurrence of a jam error prevented, and thereby a high-quality printing operation can be performed.

The present invention is not limited to the above-described embodiment and various changes can be made therein. For example, in the above-described embodiment, although a plurality of the transport belts 80 are disposed to be horizontally symmetrical in accordance with widths of a plurality of types of paper sheets P having different widths, the plurality of transport belts may be disposed to be equally spaced. In such a case, advantages of the present invention that a printing material is drawn to be curved in a direction apart away from the print head by the suction ports on both sides of the transport belts in the width direction and the printing material can be transported without being brought into contact with the print head, even in a case where ripples of cock ring are generated in the printing material can be acquired.

In addition, in this embodiment, the suction port 102 that is communicated with the space part S1 is described to be formed along the transport direction in a position adjacent to the transport belt 80. However, an example in which the position of the suction port is not limited to that of this embodiment will be described with reference to FIG. 12.

Figure 12:
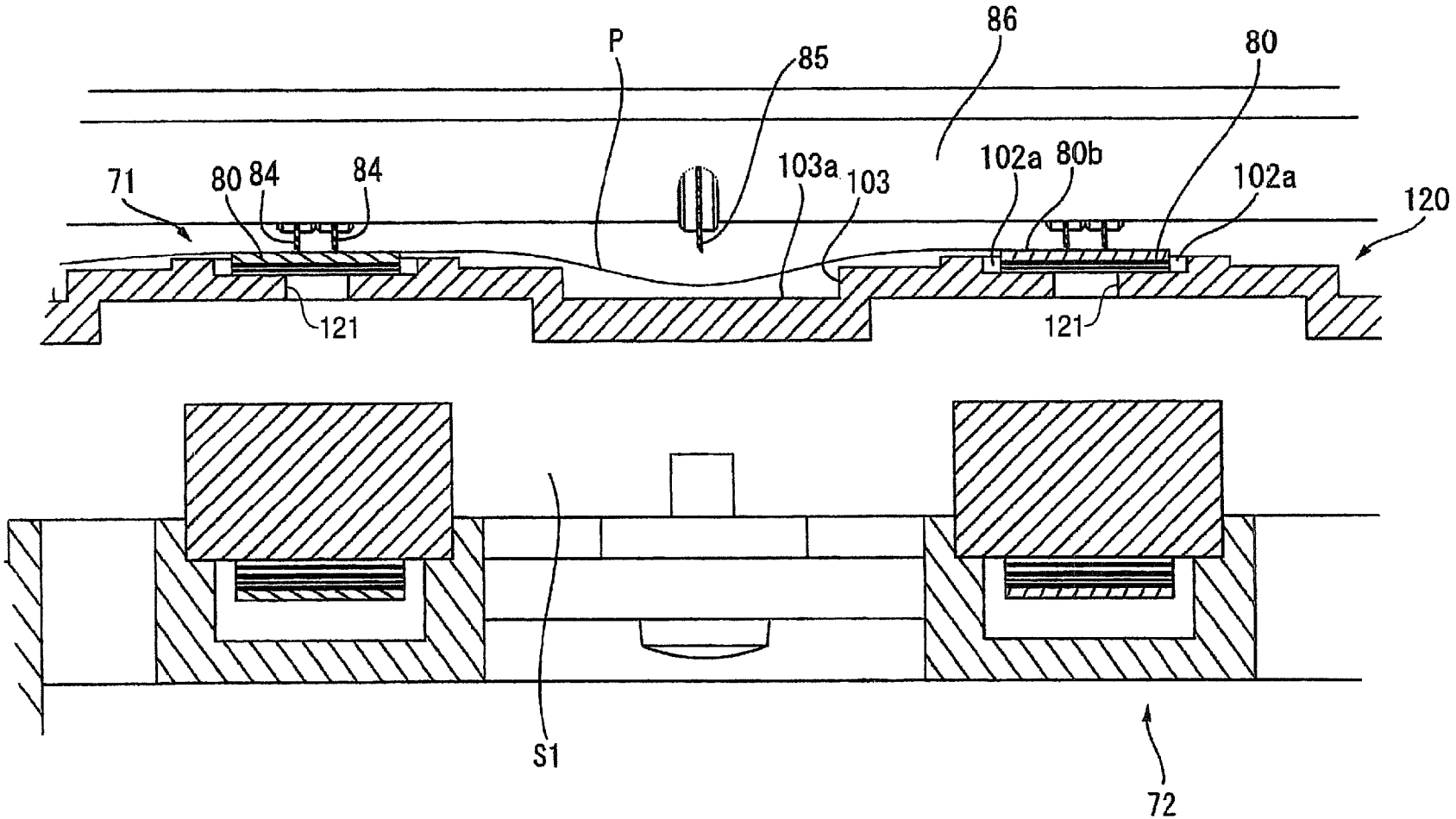
FIG. 12 is a cross-section view of a print processing unit according to a modified example of a transport mechanism in the width direction.

As shown in FIG. 12, in transport mechanism 120, a plurality of communication holes 121 that are communicated with the space part S1 is formed in a position below the center of the transport belt 80 along the width direction. The communication holes 121 are communicated with the outside in both ends of the transport belt 80 through gaps of the teeth 80*a* of the transport belt 80. The opening that is communicated with the outside is formed as a suction port 102*a* located in a position slightly lower than the transport surface 80*b*.

In this transport mechanism 120, when air inside the space part S1 is sucked by the suction blower 74, the air is sucked in from the suction ports 102*a* on both ends of the transport belts 80 through the communication hole 121 and the gaps of the teeth 80*a* of the transport belt 80.

In other words, in transport mechanism 120, the suction ports 102*a* are formed continuously in the transport direction of the transport belt 80, and a uniform suction effect can be obtained over the transport direction.

As described above, according to a printer having the above-described transport mechanism 120, gaps of the teeth 80*a* disposed on the inner face of the transport belt 80 are communicated with the suction port 102*a*. Thus, additional suction ports are not needed on both sides of the transport belt 80, and accordingly, costs can be reduced by simplifying the structure thereof.

As shown in FIG. 12, an example embodiment having one communication hole 121, which is communicated with the space part S1 and disposed in a position below the center of the transport belt 80 along the width direction, is communicated with two suction ports 102*a* disposed on both ends of the transport belt 80. However, each of the suction ports 102*a* shown in FIG. 12 may be configured to be directly communicated with the space part S1. In such a case, the transport belt 80 does not need to be a timing belt. In addition, since the flow path of the sucked air becomes a straight line formed by the suction port 102*a* and the space part S1, there is no loss, and thereby excellent efficiency is obtained.

Figure 18:
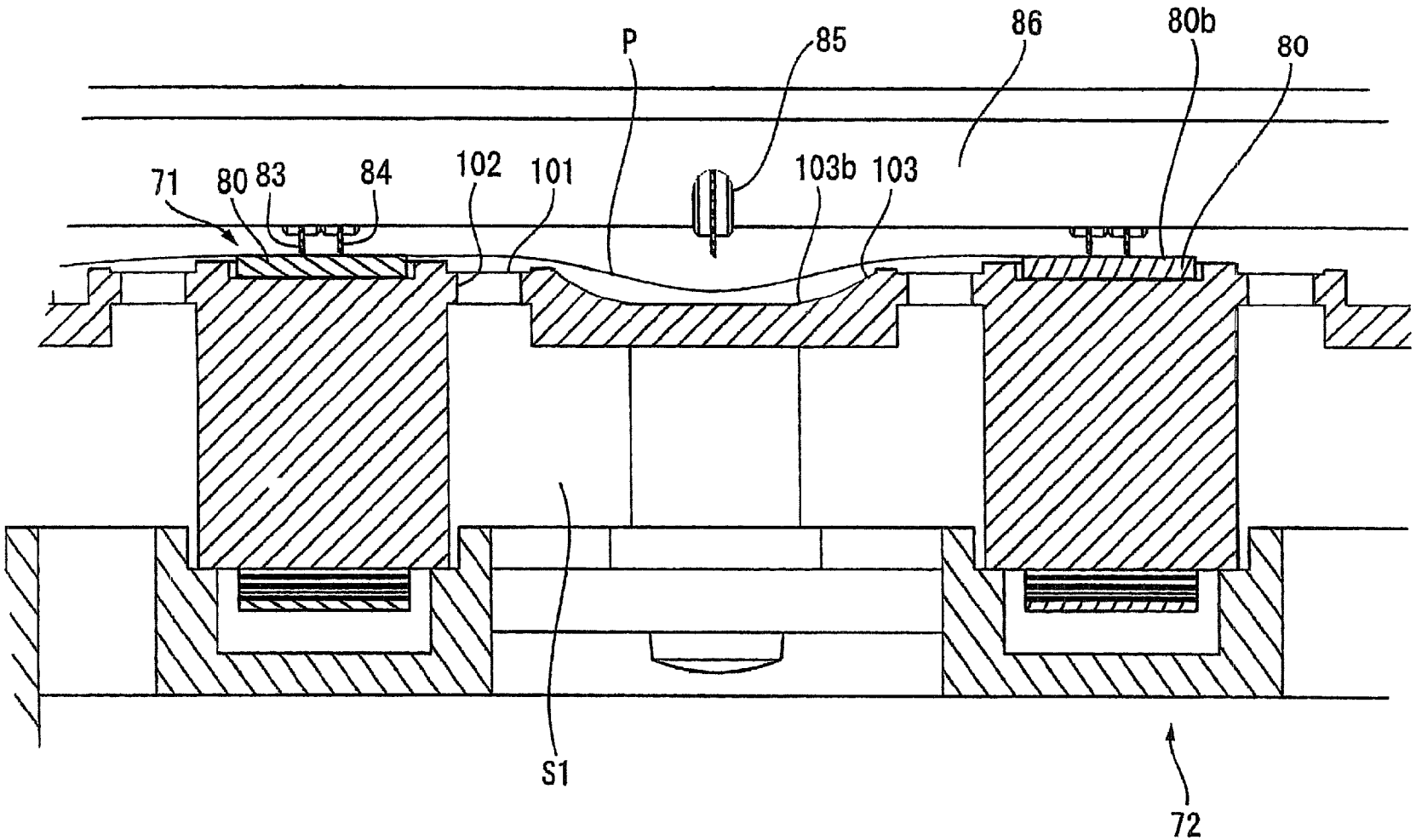
FIG. 18 is a cross-section view of a print processing unit according to a modified example of a transport mechanism in the width direction.

In addition, the concave part 103 has the bottom face 103*a* in this embodiment. However, a shape of the concave part 103 is not limited to the embodiment. As shown in FIG. 18, the concave part 103 may be a concave part comprised of a single curved face 103*b*. Further, an opening having no bottom face 103*a* may be formed in the platen 71 in place of the concave part 103. In such a case, it is necessary to replace the space part S1 so that the opening is not communicated with the space part S1.

In addition, in this embodiment, the concave part 103 formed between the transport belts 80 is configured to have the shape of a simple concave part. However, when the gap between the transport belts 80 is widened, the interval of the cock ring of the paper sheet increases, and a difference of heights of ripples formed on the top face of the paper sheet may be increased.

When the difference of the heights of the ripples formed on the top face of the paper sheet is large, landing positions of ink droplets ejected from the print head are unbalanced to cause deterioration of the print quality. Accordingly, in response to the problem, as another example of this embodiment, a support member that supports the printing material may be disposed in at least one embodiment of the present invention.

Figure 13:
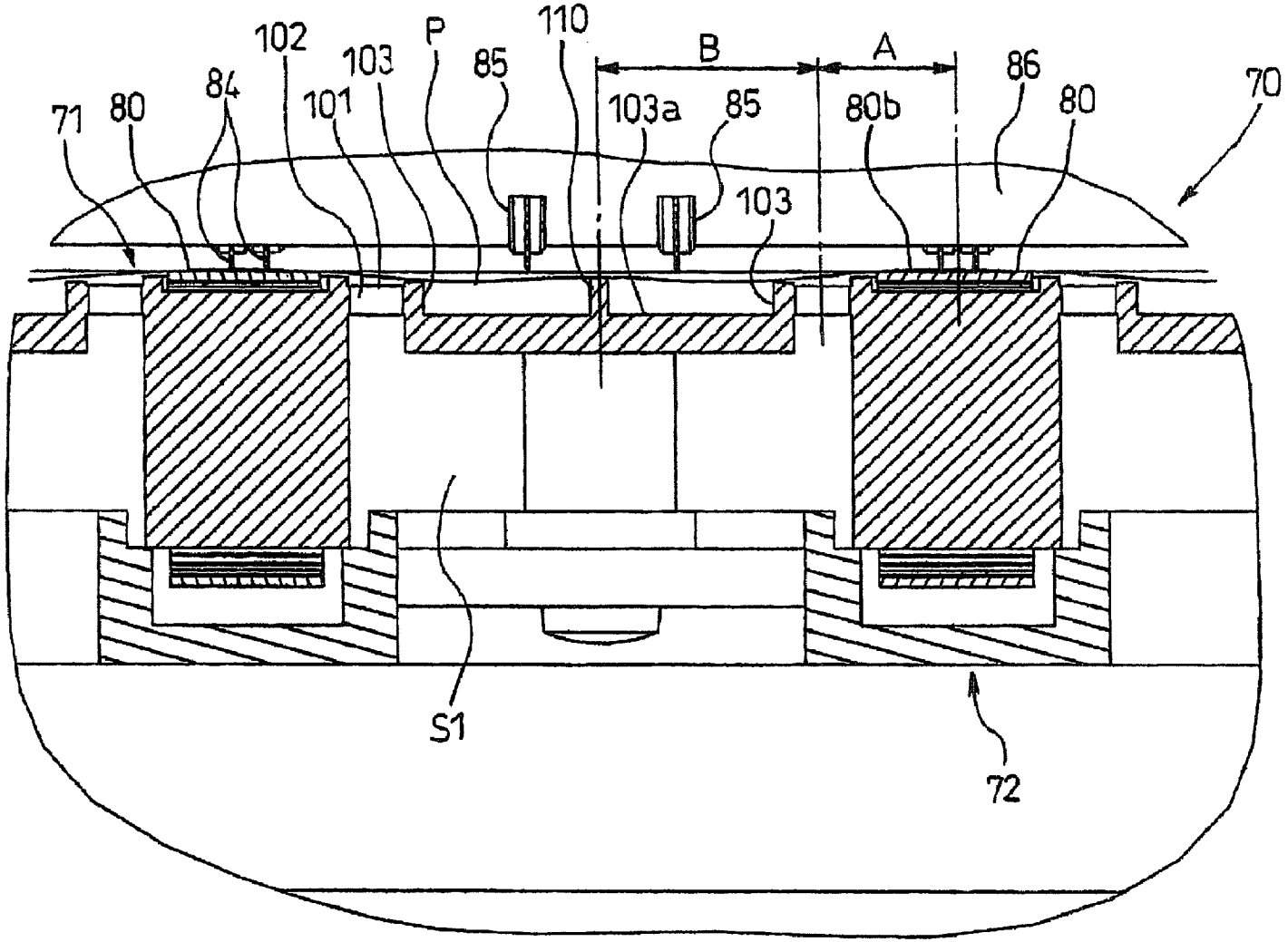
FIG. 13 is a cross-section view of a print processing unit in the width direction.
Figure 14:
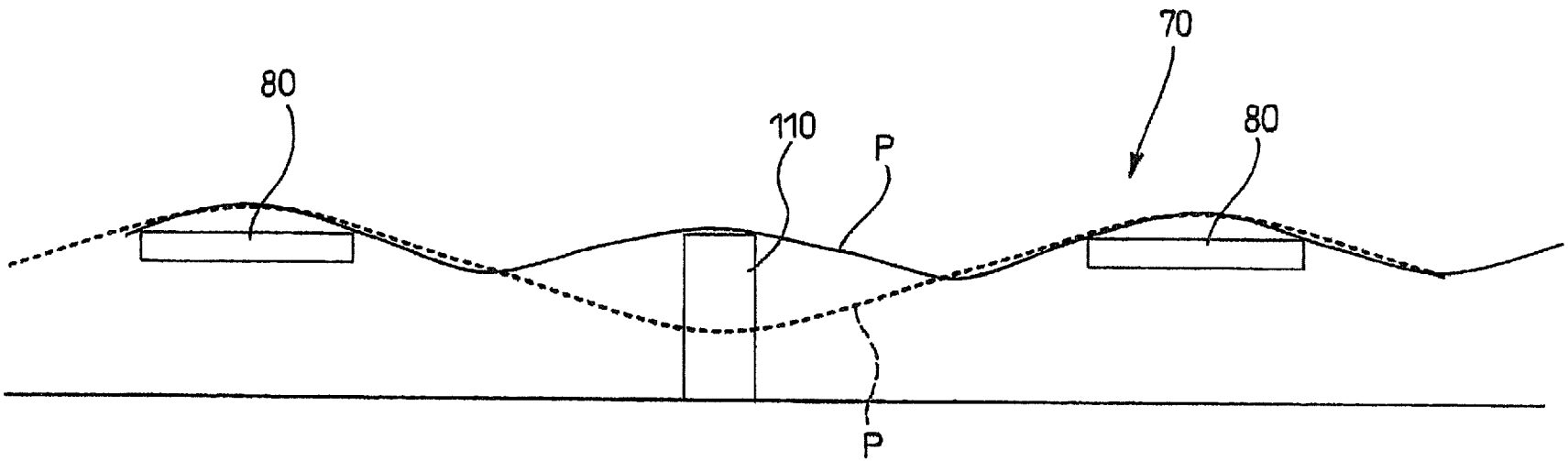
FIG. 14 is a schematic cross-section view of a print processing unit showing the state of generation of ripples of a paper sheet.

This embodiment will now be described with reference to FIGS. 13 and 14. For the description, to each component that is the same as that of the above-described embodiment or has the same function as that of the above-described embodiment, a same reference symbol is assigned, and a description thereof is omitted here. FIG. 13 is a cross-section view of a print processing unit in the width direction. FIG. 14 is a schematic cross-section view of the print processing unit showing the state in which ripples are generated in a paper sheet.

As shown in FIG. 13, similarly to FIG. 7 described above, on the top face of a suction block 72, a suction face 101 is formed along a transport belt 80. In this suction face 101, a plurality of suction ports 102 that are communicated with a space part S1 is formed along the transport direction. In addition, a concave part 103 is formed between the suction ports 102 adjacent to each other in the width direction of the transport belt 80.

In this embodiment, between the transport belts 80, in at least a print area of the ink jet head 22, a rib (support part) 110 is formed and disposed along the transport direction of the paper sheet P transported by the transport belt 80. The rib 110 is installed on a bottom face 103*a* of the concave part 103 facing the upper side.

Here, the top end of the rib 110 is positioned to be lower than the transport surface 80*b* of the transport belt 80 and is positioned to be higher than the suction face 101.

In addition, the rib 110 is formed in the center of the transport belts 80, and a distance B between the center of the suction port 102 and the center of the rib 110 is configured to be longer than a distance A between the center of the suction port 102 and the center of the transport belt 80.

In addition, between the transport belt 80 and the rib 110, a pressing roller 85 is disposed.

As described above, when a printing operation for the paper sheet P is performed, there is a case where cock ring in which the paper sheet P is swollen with ripples generated by the ink droplets ejected from the ink jet head 22 may occur. However, the paper sheet P is sucked downward by the suction port 102, and accordingly, swell of the paper sheet P from the transport belt 80 is suppressed. In a case where the rib 110 is not disposed, when the ripples of the paper sheet P are large, the difference of heights of the surface of the paper sheet P increases. Thus, the landing positions of the ink droplets ejected from the ink jet head 22 are unbalanced causes deterioration of the print quality.

However, in the printer 1 according to this embodiment, the rib 110 is disposed between the transport belts 80, and accordingly, the paper sheet P is supported by the rib 110 that is disposed between the transport belts 80.

FIG. 14 shows the state in which the ripples of the paper sheet P are generated. In FIG. 14, a broken line represents a state of the paper sheet P for a case where the rib 110 is not disposed, and a solid line shows the state of the paper sheet P for a case where the rib 110 is disposed.

As shown in FIG. 14, when the rib 110 is not disposed, the interval of the cock ring of the paper sheet P increases, and accordingly, the difference of heights due to ripples formed on the surface of the paper sheet P increases. On the other hand, when the rib 110 is disposed, the interval of the cock ring of the paper sheet P decreases, and accordingly, the difference of heights due to ripples formed on the surface of the paper sheet P decreases.

As described above, when a paper sheet P is transported in a transport mechanism in which the rib 110 is disposed, a support part formed of the rib 110 is disposed along the transport direction of the paper sheet P between the transport belts 80 in at least a printing area of the ink jet head 22. Accordingly, even when the interval of the cock ring of the paper sheet P is increased due to adherence of ink, the paper sheet P can be supported by the rib 110 between the transport belts 80. Accordingly, the interval of the cock ring of the paper sheet P can be decreased, and the difference of heights due to the ripples formed on the surface of the paper sheet P can be decreased, and thereby a quality print state can be obtained.

In other words, the paper sheet P is smoothly transported at high precision by suppressing contact between the paper sheet P and the ink jet head 22, occurrence of a paper jam error, and the difference of heights of the ripples due to cock ring, and thereby performing a quality printing operation.

In addition, the bottom face 103*a* of the concave part 103 located between the transport belt 80 and the rib 110 is positioned lower than the suction port 102. Accordingly, contact between the paper sheet P curved by suction and the platen side does not occur, and transport resistance is not increased, and thereby the paper sheet P can be transported with high precision. As a result, a printing operation with high precision can be performed.

In addition, the distance A between the transport belt 80 and the suction port 102 is shorter than the distance B between the rib 110 and the suction port 102. Accordingly, while the suction effect for the paper sheet P in the suction port 102 is well exhibited, the generation of the ripples of the paper sheet P can be suppressed by the rib 110.

In addition, the height of the rib 110 is lower than the transport surface 80*b* of the paper sheet P, which is formed by the transport belt 80. Accordingly, unnecessary contact between the paper sheet P, in which cock ring scarcely occurs before adherence of ink or the like, and the rib 110 can be suppressed, and thereby the paper sheet P can be well transported.

In addition, in the transport mechanism 70, on the upstream side of a position in which the paper sheet P is pinched on the downstream side in the transport direction, the pressing roller 85 presses the paper sheet P in a position facing the concave part 103, and accordingly, the swell of the paper sheet P between the transport belt 80 and the rib 110 can be more reliably prevented.

In addition, by using a timing belt as the transport belt 80, the transport operation can be controlled with high precision regardless of the thickness of the transport belt 80. In addition, the precision of transport of the paper sheet P can be increased without idle rotating the transport belt 80, and thereby a printing operation can be performed with high precision.

In addition, in the above-described embodiment, in order to suppress generation of the ripples of the paper sheet P due to the cock ring, the rib 110 is formed as the support part that supports the paper sheet P between the transport belts 80. However, the support part for the paper sheet P is not limited to the rib. Thus, a support roller that turns about an axis line orthogonal to the transport direction of the paper sheet P may be arranged along the transport direction of the paper sheet P, or the rib and the support roller may be combined to be used.

Figure 15:
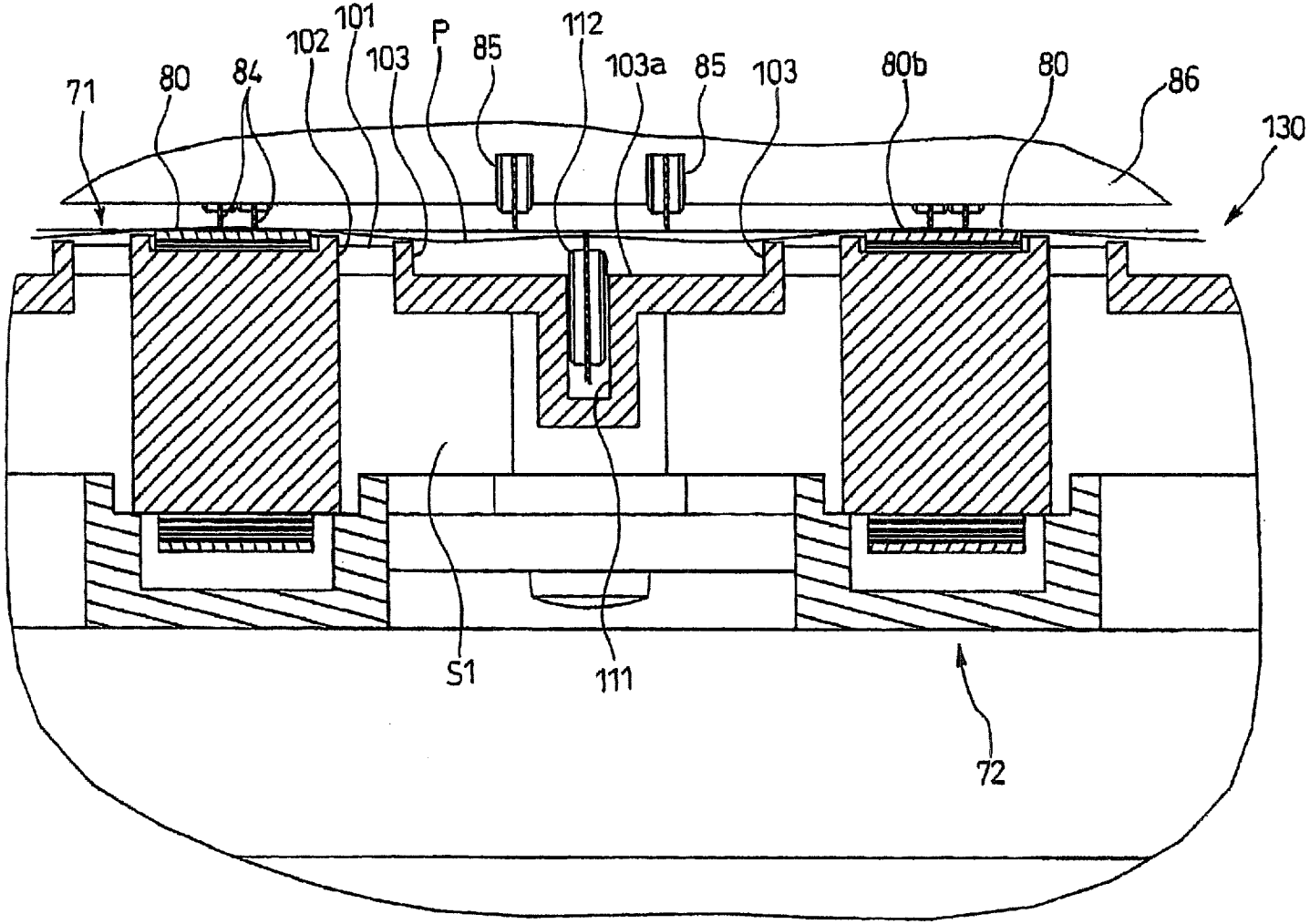
FIG. 15 is a cross-section view of a print processing unit in the width direction showing a modified example of the transport mechanism.
Figure 16:
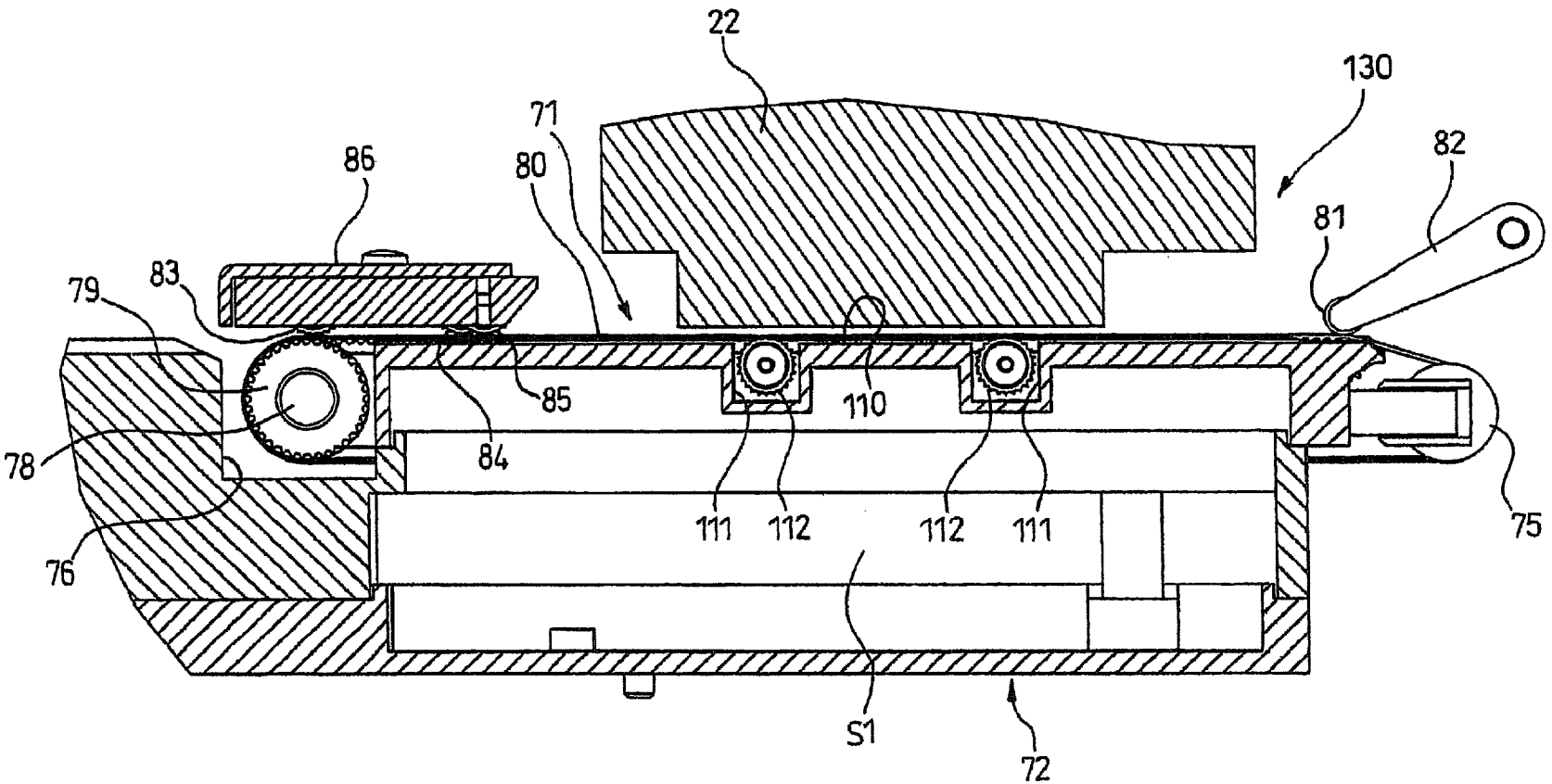
FIG. 16 is a cross-section view of the print processing unit according to a modified example of the transport mechanism between the transport belts in the transport direction of the paper sheet.

In addition, the present invention is not limited to the above-described embodiment in which the rib is disposed, and various changes can be made therein. An example will be described with reference to FIGS. 15 to 17. FIG. 15 is a cross-section view of a print processing unit according to a modified example of the transport mechanism, in the width direction. FIG. 16 is a cross-section view of the print processing unit according to a modified example of the transport mechanism between the transport belts in the transport direction of the paper sheet.

FIGS. 15 and 16 show examples in which the rib and the support roller are combined to be used.

As shown in FIGS. 15 and 16, in this transport mechanism 130, a receiving hole 111 that is dug downward is formed in a part of a position in which the rib 110 is formed. In addition, inside the receiving hole 111, a support roller 112 that turns about an axis line orthogonal to the transport direction of the paper sheet P is disposed. In addition, the upper end of the support roller 112 coincides with the upper end of the rib 110.

Even in a printer 1 having the above-described transport mechanism 130, the paper sheet P can be well supported between the transport belts 80 by the support part that is formed by the roller 112 disposed between the transport belts 80 in at least a printing area of the print head 22. Accordingly, the interval of cock ring of the paper sheet P can be decreased, and the difference of heights of the ripples formed on the surface of the paper sheet P can be decreased. Therefore, a quality print state can be obtained.

Figure 17:
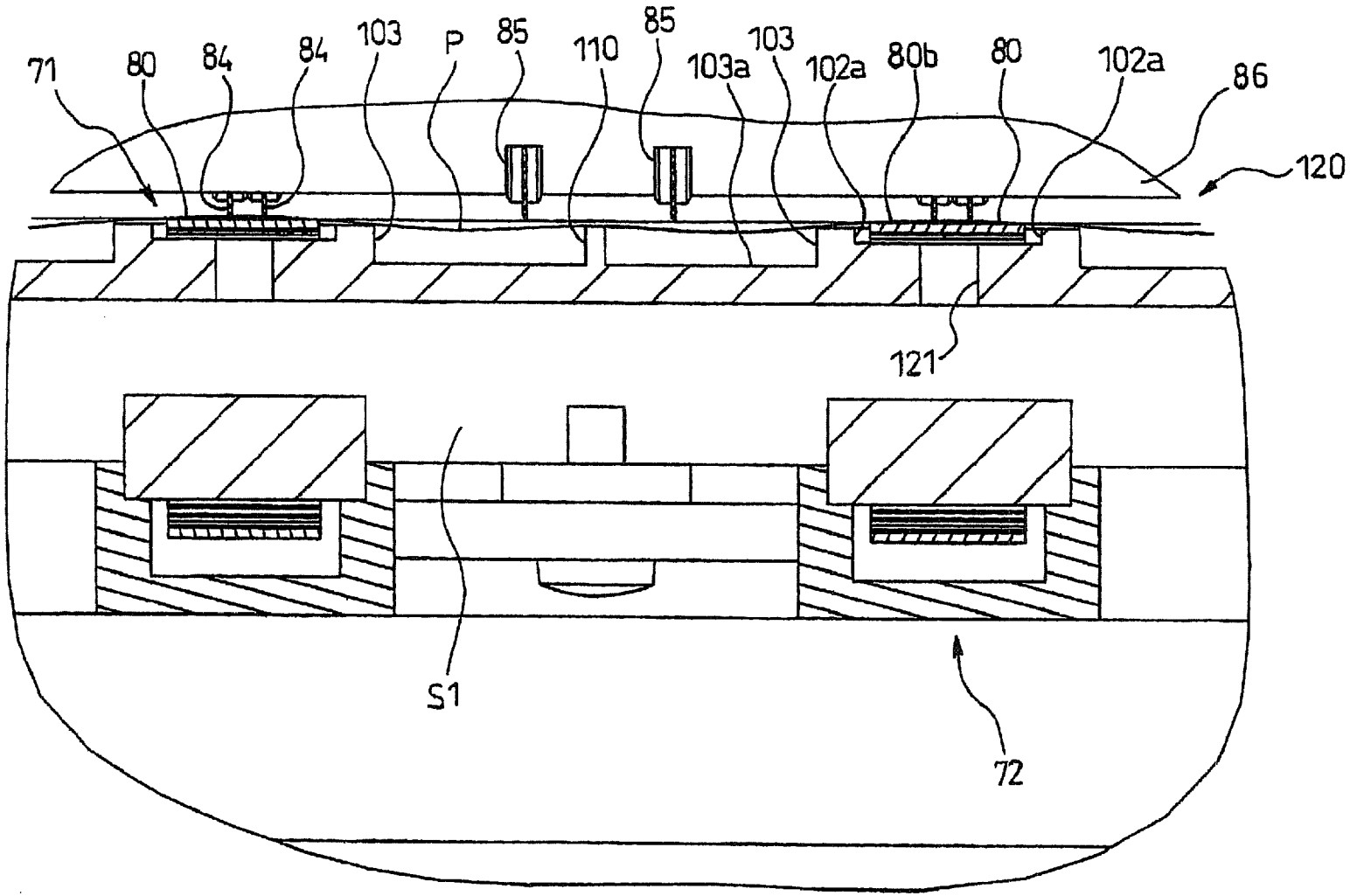
FIG. 17 is a cross-section view of a print processing unit according to a modified example of a transport mechanism in the width direction.

FIG. 17 shows another example of a transport mechanism that is appropriate for the above-described printer 1.

As shown in FIG. 17, in this transport mechanism 120, a plurality of communication holes 121 that are communicated with the space part S1 is formed in a position below the center of the transport belt 80 in the width direction. The communication holes 121 are communicated with the outside on both side-end parts of the transport belt 80 through gaps of the teeth 80*a* of the transport belt 80. In addition, an opening that is communicated with the outside thereof is formed as a suction port 102*a* that is located in a position slightly lower than the transport surface 80*b*.

What is claimed is:

1. A liquid ejecting apparatus comprising:

a transport mechanism that transports a sheet in a first direction; and a liquid ejecting head that ejects liquid onto the sheet;

wherein the transport mechanism includes:

a plurality of transport belts that transports the sheet and arranged in a second direction which is orthogonal to the first direction, each of the transport belts extending in the first direction and having a transport surface with which the transported sheet is brought into contact;

a concave portion formed with a support member that supports the transported sheet and arranged along the first direction, the concave portion being disposed between the transport belts adjacent to each other in the second direction; and a plurality of suction ports that sucks the sheet and disposed on both sides of the concave portion in the second direction;

wherein a distance between the liquid ejecting head and a suction surface of each of the suction ports is longer than a distance between the liquid ejecting head and the transport surface; and wherein a distance between the liquid ejecting head and a bottom of the concave portion is longer than the distance between the liquid ejecting head and the suction surface.

2. The liquid ejecting apparatus as set forth in claim 1, further comprising a platen facing the liquid ejecting head, wherein the platen is formed with the suction ports and the concave portion.

3. The liquid ejecting apparatus as set forth in claim 1, wherein the bottom of the concave portion has a flat bottom face; and wherein a distance between the liquid ejecting head and the flat bottom face of the concave portion is longer than the distance between the liquid ejecting head and the suction surface.

4. The liquid ejecting apparatus as set forth in claim 1, wherein the suction ports are disposed in both side ends of each of the transport belts in the second direction.

5. The liquid ejecting apparatus as set forth in claim 1, wherein the transport mechanism has a pressing roller that presses the sheet toward the concave portion and disposed in a downstream side with respect to the liquid ejecting head in the first direction.

6. The liquid ejecting apparatus as set forth in claim 1, wherein the transport belts are arranged in the second direction such that the transport belts for transporting the sheets are disposed at least in the vicinity of both side ends of respective sheets when the transport belts transport the sheets having different size in the second direction with each other.

7. The liquid ejecting apparatus as set forth in claim 6, wherein the respective transport belts for transporting the sheets disposed in the vicinity of the both side ends of the respective sheets are disposed in symmetrical positions with respect to the both side ends of the respective sheets.

8. The liquid ejecting apparatus as set forth in claim 6, wherein the respective sheets having different size with each other are transported along a common reference position.

9. The liquid ejecting apparatus as set forth in claim 1, wherein the support member includes a rib protruded toward the liquid ejecting head.

10. The liquid ejecting apparatus as set forth in claim 1, wherein the support member includes a plurality of rollers, each of which is rotatably supported by an axis which extends in the second direction.

11. The liquid ejecting apparatus as set forth in claim 1, wherein a distance between one of the transport belts and one of the suction ports is shorter than a distance between the support member and the one of the suction ports.

12. The liquid ejecting apparatus as set forth in claim 1, wherein a distance between the liquid ejecting head and the support member is longer than the distance between the liquid ejecting head and the transport surface.

* * * * *